US005881939A

United States Patent [19]

Kikuchi et al.

[11] Patent Number: 5,881,939

[45] Date of Patent: Mar. 16, 1999

[54] BELT TYPE WOVEN MATERIAL PROCESSING APPARATUS

[75] Inventors: Koichi Kikuchi; Tadashi Tukamoto, both of Shizuoka, Japan

[73] Assignee: Kikuchi Web Tech Co., Ltd., Shizuoka, Japan

[21] Appl. No.: 885,245

[22] Filed: Jun. 30, 1997

[30] Foreign Application Priority Data

Sep. 13, 1996 [JP] Japan ..... PCT/JP96/2643

[51] Int. Cl.[6] ..... B65H 20/00

[52] U.S. Cl. ..... 226/180; 226/189; 242/615.21

[58] Field of Search ..... 242/615.21; 226/180, 226/189

[56] References Cited

U.S. PATENT DOCUMENTS

| | | | |
|---|---|---|---|
| 2,495,909 | 1/1950 | Ross | 242/615.21 |
| 2,760,773 | 8/1956 | Brodie | 242/615.21 |
| 4,788,846 | 12/1988 | Morita et al. | 242/615.21 |
| 5,100,117 | 3/1992 | Hajek et al. | 242/615.21 |
| 5,108,022 | 4/1992 | Birkmair et al. | 242/615.21 |
| 5,199,351 | 4/1993 | Shibuya et al. | 242/615.21 |
| 5,359,743 | 11/1994 | Von Harten et al. | 8/151 |
| 5,487,512 | 1/1996 | Norjiri et al. | 242/471 |

*Primary Examiner*—William Stryjewski
*Attorney, Agent, or Firm*—Greer, Burns & Crain, Ltd.

[57] ABSTRACT

In a continuous cloth strip processing apparatus for at least one long belt-like cloth strip, a cloth strip traveling direction changing apparatus which has both an introduction guide roller having a rotational axis which is perpendicular to the cloth strip which is introduced and a withdrawal guide roller having a rotational axis which is perpendicular to the cloth strip which is withdrawn and which has an arbitrarily set relative angle between the rotational axes of these two rollers is provided at an input part, an output part or within at least one processing section that forms the processing zones.

22 Claims, 22 Drawing Sheets

Fig. 7A
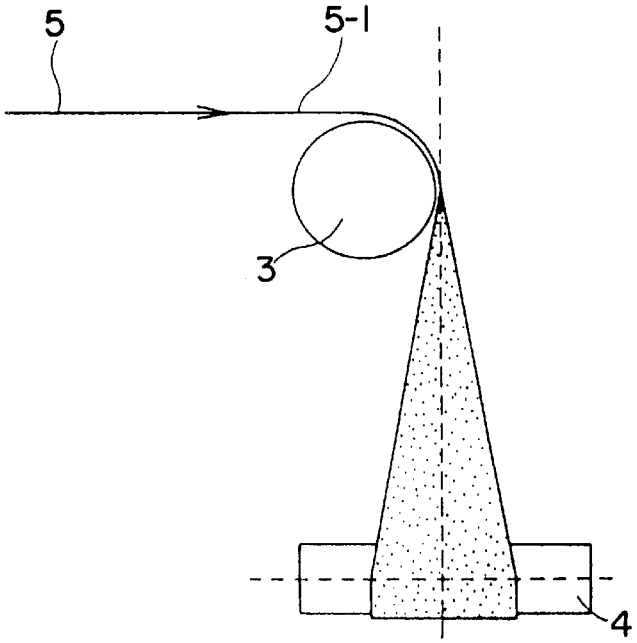
Fig. 7B
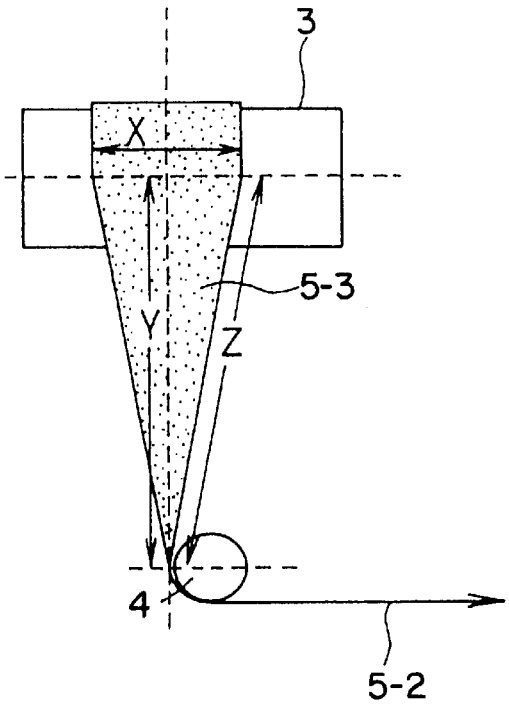
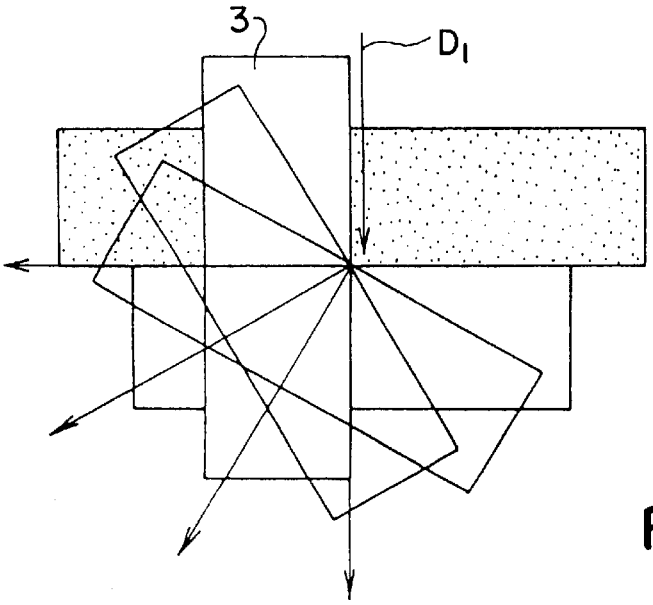
Fig. 7C 9
6
5
3
11
O1
4
13
12
O2
61
11'

BELT TYPE WOVEN MATERIAL PROCESSING APPARATUS

This application is based International Application No. PCT/JP96/02643, filed Sep. 13, 1996.

FIELD OF THE INVENTION

The present invention relates to a processing apparatus for belt-type cloth, and more specifically it relates to an apparatus for processing such as dyeing, thermal treatment, scouring, and finishing of narrow belt-like cloth strips such as seat-belt material.

DESCRIPTION OF THE RELATED ART

In the past, when performing processes such as dyeing, thermal treatment, scouring, and finishing of narrow belt like cloth strips such as used in safety belts, seat-belts, and slings, the general approach was one of performing the series of processes, starting from the raw fabrics or grey fabrics feeding processes and proceeding through the scouring, color-developing, cleaning, drying, heat setting, and application of a surface treating agent. These processing steps were performed in serial fashion as a plurality of long cloth strips are caused to pass thereby.

For example, in a general example of performing the above-noted type of processing on a narrow belt of woven or knitted fabrics made mainly of polyester synthetic fibers or filaments to obtain a final product, as shown in FIG. 14, the cloth strip is passed continuously by the plurality of processing stages in serial fashion as each process is performed. The cloth strip is so arranged that a plurality of strips are moved in parallel to each other.

That is, a plurality of processes are continuously and sequentially arranged and the cloth strip is fed continuously and sequentially past each process, such as a means (1) for preparing raw fabrics and supplying the downstream processes, a dye immersion and squeezing process (2), a drying process (3), a color development (thermosol) process (4), a water rinse (washing) process (5), a drying process (6), an oil/resin immersion and squeezing process (7), a pre-drying process (8), a curing process (9), and a product pickup process (10), the prescribed process being performed at each stage as shown in FIG. 14.

In the prior art method of performing the above-noted processes, because of the requirement to perform each of the processes efficiently and in as little as time as possible to produce a finished product, in addition to continuously feeding the cloth strip up to the last process, without stopping it midway, the processing apparatuses corresponding to each of the above-noted processes are disposed in a linear arrangement, with the cloth strip, which is the product being processed, traveling at a prescribed traveling speed along each of the processing apparatuses in an approximate straight line.

To achieve the above-noted processing, because the traveling speed of the cloth strip is fixed in the same pre-established condition for all of the processes, and since the time required for completion of each required process may be different, it was necessary either to make the various processing apparatuses as long as required to complete that process, or to provide a plurality of the same processing apparatuses so that the same processes is repeated in order to complete that particular process.

However, in the processing apparatuses used in the above-noted continuous processing of a cloth strip in the, prior art, because a space of considerable length was required to keep the cloth strip straight from a raw fabric supplying device, which corresponds to the means (1) to prepare the raw fabric, to the final process (10), at which the finally finished product is picked up, it was difficult to introduce a continuous processing apparatus for cloth strip, unless the size of the land on which the plant is to be disposed had a space of sufficient length.

In the above-described processes in the prior art, because of the need to feed a cloth strip in a linear and parallel configuration as much as possible, there are cases in which a number of the processing apparatuses for the above-noted processes must be arranged so that they are forced to be unnecessarily large or must be unnecessarily duplicated, the result being not only an increase in the cost of facilities, but also an increase in the energy consumed by each of the processes, this leading to a significant increase in production cost.

DISCLOSURE OF THE INVENTION

To provide an improvement with respect to the above-noted defects in the prior art, an object of the present invention is to provide a processing apparatus for a cloth strip which, by processing the cloth strip efficiently, at high speed, and with a considerable reduction in power consumption, is capable of reducing the production cost.

To achieve the above-noted object, the present invention includes the following.

Specifically, the first aspect of the present invention is a continuous cloth strip processing apparatus which continuously processes at least one long cloth strip which moves continuously through a plurality of processings zones as it is processed by the prescribed process in each zone, wherein at least one of the processing sections which form each one of the processing zones has at its entrance part or exit part or therewithin at least one cloth strip traveling direction changing apparatus having an introduction guide roller which has a rotational axis that is perpendicular with respect to the center line of the cloth strip which runs into it, and a withdrawal guide roller which has a rotational axis that is perpendicular with respect to the center line of the cloth strip that is withdrawn therefrom, the relative angle between these axes of two guide rollers being arbitrarily set.

The second aspect of the present invention is a continuous cloth strip processing apparatus which uses a cloth strip traveling direction changing apparatus of the configuration noted above, and is configured so that at least one long cloth strip runs continuously through a plurality of processing zones as it is processed by the prescribed processing thereof. In addition, the sequence of the physical arrangement of the above-noted plurality of processing sections, which forms the above-noted continuous processing apparatus, and the sequence of the processing sections through which the cloth strip travels can be different from each other.

The third aspect of the present invention is a continuous cloth ship processing apparatus configured so tat at least one long cloth strip runs continuously by a plurality of processing zones as it is processed by the prescribed processing thereof, at least one part of the plurality of processing sections which forms the continuous processing apparatus is orientated so as to be non-collinear with the other processing sections.

The fourth aspect of the present invention is a continuous cloth strip processing apparatus configured so that at least one long cloth strip runs continuously by a plurality of processing zones as it is processed by the prescribed processing thereof, and further configured so that a cloth strip which has first passed by at least a first processing section which forms part of the above-noted plurality of processing sections and received processing thereby moves to another second processing section, at which it receives processing that is different from the processing of the first processing section, after which it is caused to return to the first processing section.

BRIEF DESCRIPTION OF THE DRAWINGS

FIGS. 7(A) to 7(C) are drawings which illustrate the configurational conditions of the cloth strip traveling direction changing apparatus according to the present invention.

BEST MODE TO CARRY OUT THE INVENTION

Examples of the various aspects of a processing apparatus according to the present invention will be described in detail below, with reference being made to the appropriate accompanying drawings.

Figure 1:
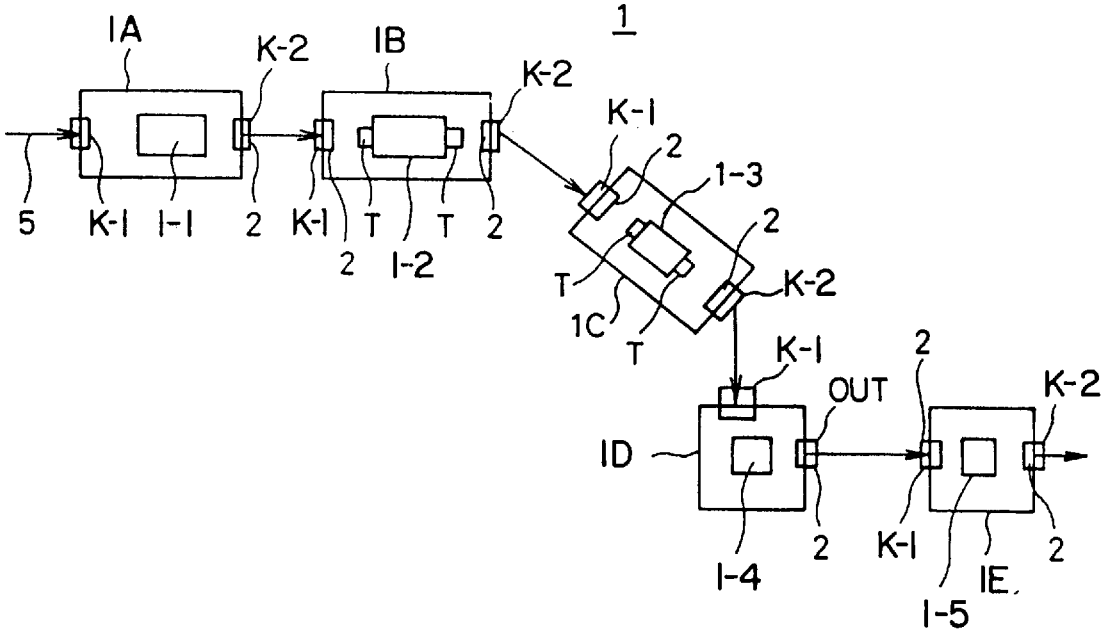
FIG. 1 is a plan view which shows the arrangement of each processing zone and the traveling direction of a cloth strip in a first example of a continuous processing apparatus according to the present invention.
Figure 2:
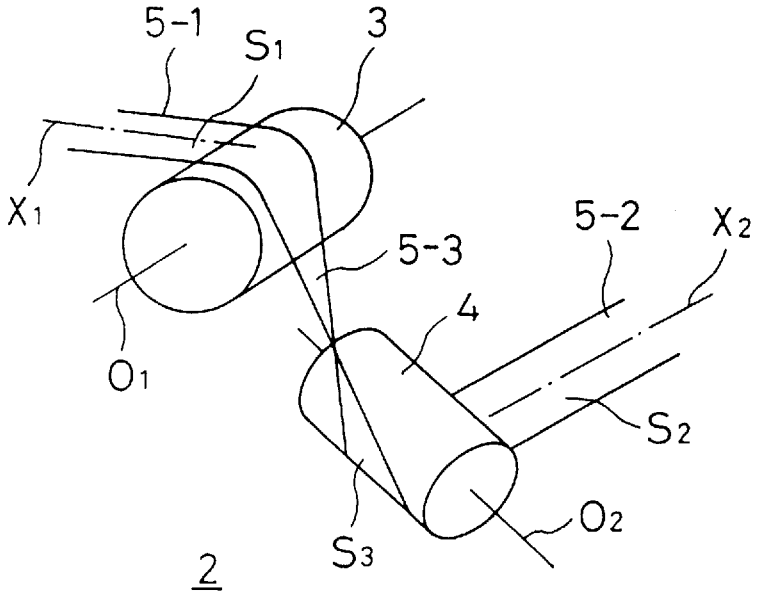
FIG. 2 is a perspective view which illustrates the configuration and function of a cloth strip traveling direction changing apparatus according to the present invention.

FIG. 1 is a simplified drawing of an example of the arrangement and configuration of the plurality of processing zones 1-1 through 1-5 of a continuous cloth strip processing apparatus 1 according to the present invention, and FIG. 2 is a drawing which provides a simplified illustration of the configuration of an example of a cloth strip traveling direction changing apparatus 2 which is used within at least one section of the processing sections 1A through 1E which form the plurality of separate processing zones 1-1 through 1-5 of a continuous cloth strip processing apparatus according to the present invention.

As shown in FIG. 1, the cloth strip traveling direction changing apparatus 2 according to the present invention is provided at an entrance section K-1, an output section K-2, or within the associated processing section. As shown in FIG. 2, the configuration of this cloth strip traveling direction changing apparatus 2 is such that it has an introduction guide roller 3 which has a rotational axis $\mathbf{0}_1$ that is perpendicular with respect to the center line $X_1$ of the cloth strip 5-1 which runs into it, and a withdrawal guide roller 4 which has a rotational axis $\mathbf{0}_2$ that is perpendicular with respect to the center line $X_2$ of the cloth strip S-2 which is withdrawn therefrom, the relative angle θ between these rotational axes $\mathbf{0}_1$ and $\mathbf{0}_2$ of the two guide rollers 3 and 4, respectively, being arbitrarily settable.

In performing a plurality of prescribed processes on a cloth strip in the past, in the case in which processing at the respective processes is performed continuously, without interrupting the traveling of the cloth strip, when the cloth strip is to be twisted at one step or location as it is fed while processing, because of the adverse influence on the cloth strip processing quality that was envisioned, as described earlier, the general approach when performing a plurality of processing steps on the cloth strip was to have the various processing zones arranged in nearly collinear fashion, the cloth strip being caused to run in an approximate straight line by the processing zones arranged in collinear fashion so as to perform the prescribed processing thereon, resulting in the above-described problems.

In the present invention, the technical concept of the past when performing continuous processing of a cloth strip has been improved, so that in performing the prescribed processing on a cloth strip which is caused to pass by a plurality of processes, by imparting a twist to the cloth strip as it passes a prescribed processing zone, or as it passes between processing zones, the traveling direction of the cloth strip is caused to change arbitrarily, enabling an improvement in the degree of freedom with respect to arrangement of the positions of the processing sections in the plurality of processing zones that are required.

Therefore, in the present invention, it is not only possible to arbitrarily arrange the positions of the plurality of steps of processing zones which are used in a continuous cloth strip processing apparatus 1 in which the cloth strip is processed by a plurality of prescribed processes, including arranging them in a straight line, but also to set the traveling direction of the cloth strip 5 as a straight line as a configuration other than a straight line.

As a result, in the case of performing a prescribed plurality of processes on the cloth strip, it is possible to efficiently design the position of the processing sections, which make up each of the processing zones, and because it is also possible to re-use a prescribed processing section which makes up a processing zone, it is not only possible to efficiently perform overall production control, including control of the conditions of each process, but also to enable operations in these processing sections to be improved so as to greatly reduce the overall production cost.

In addition, in the present invention, in order to establish the most efficient production system, it is possible to configure the arrangement of the plurality of processing zones arbitrarily, including a three-dimensional arrangement, in contrast to the prior art. In addition to it being possible to greatly reduce the amount of space the continuous cloth strip processing apparatus occupies within a processing plant, it is possible to freely design a continuous cloth strip processing apparatus to be suitable to the space within an existing plant land area, thereby providing a great improvement in the degree of freedom of designing a continuous cloth strip processing apparatus.

Furthermore, in the present invention, because it is possible to establish the traveling direction of the cloth strip arbitrarily, including traveling along a curve and reverse traveling, without being restricted to straight-line traveling, it is possible to have a cloth strip that has, for example, passed by one processing zone and return to that same processing zone. This makes it possible to eliminate part of the extra processing zones that were needed in the past to satisfy the processing conditions when performing the prescribed processing on a cloth strip, thereby providing, in addition to the above-noted savings in space, a reduction in the overall amount of energy required for the processing of the cloth strip.

Specifically, the cloth strip traveling direction changing apparatus 2 which is formed by the introduction guide roller and withdrawal guide roller shown in FIG. 2 and FIG. 7 according to the present invention is desirably configured so that by arbitrarily setting the relative angle θ between the rotation axes $\mathbf{0}_1$ and $\mathbf{0}_2$ of the above-noted introduction guide roller 3 and withdrawal guide roller 4, respectively, it is possible to arbitrarily set the traveling direction or the traveling path of the cloth strip which runs within a processing section.

Figures 10A, 10B:
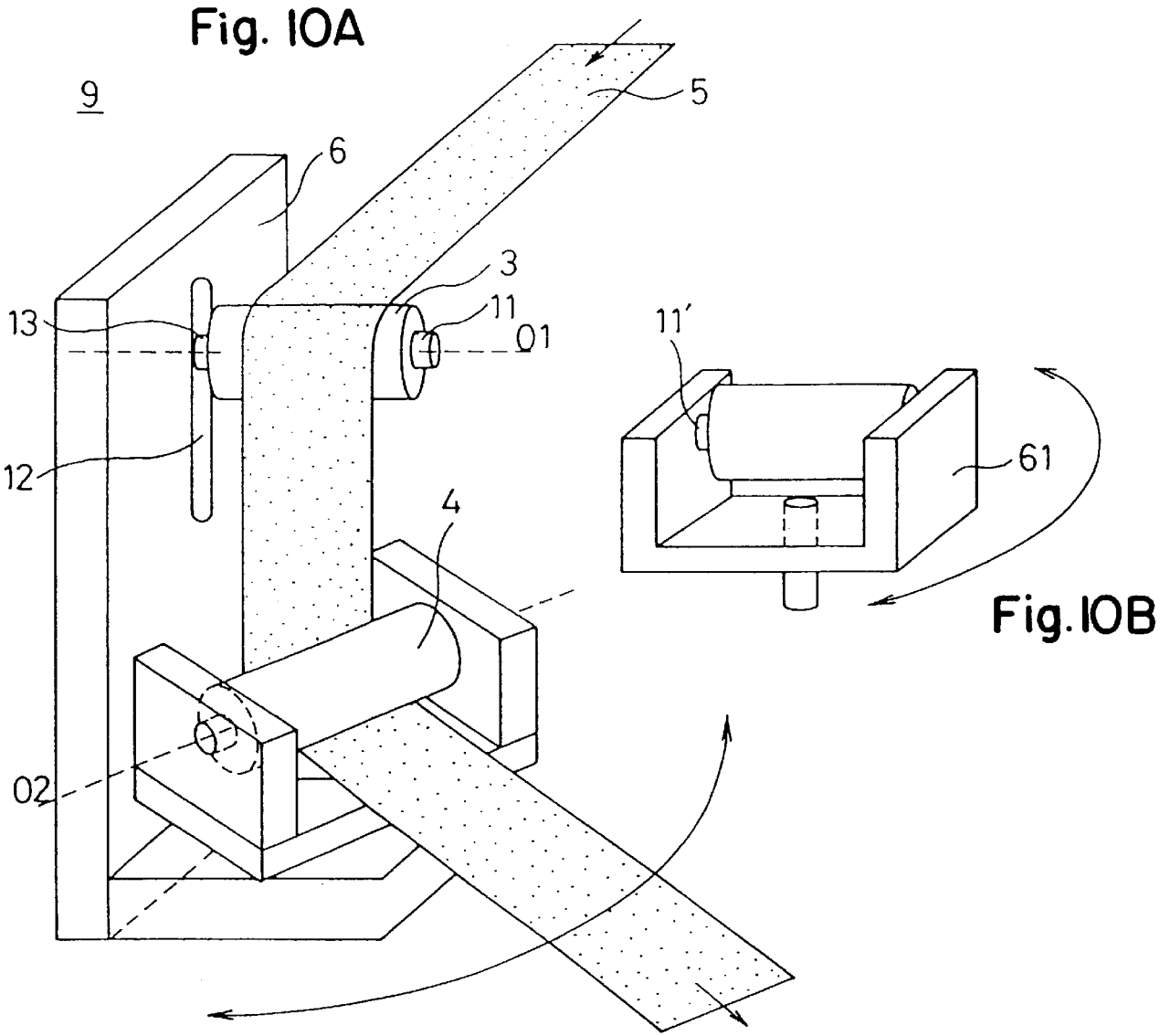
FIGS. 10(A) and 10(B) are perspective views which illustrate the configuration of another example of a cloth strip traveling direction changing apparatus according to the present invention.
Figure 11:
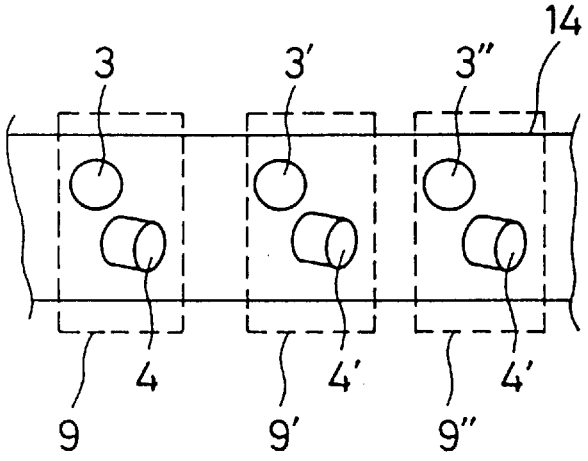
FIG. 11 is a drawing which shows an example of a form of use of a cloth strip traveling direction changing apparatus according to the present invention.

The configuration of the cloth strip traveling direction changing apparatus 2 according to the present invention is not particularly limited, and can have any type of configuration, as long as the configuration allows the rotational axis of either one of the above-noted introduction guide roller 3 and withdrawal guide roller 4 to be set at a prescribe or arbitrary relative angle with respect to the rotational axis of the other roller. For example, it is possible to have a unit configuration 9 as shown in FIG. 10, in which either one of the above-noted introduction guide roller 3 and withdrawal guide roller 4 supported by a pivotable frame 6" which is rotatably linked to a frame 6 onto which the other roller is mounted.

In the present invention, it is also possible to have a configuration in which it is possible to change the angle of either the rotational axes $\mathbf{0}_1$ and $\mathbf{0}_2$ of the introduction guide roller 3 and the withdrawal guide roller 4 with respect to the other rotational axis.

Figure 3A:
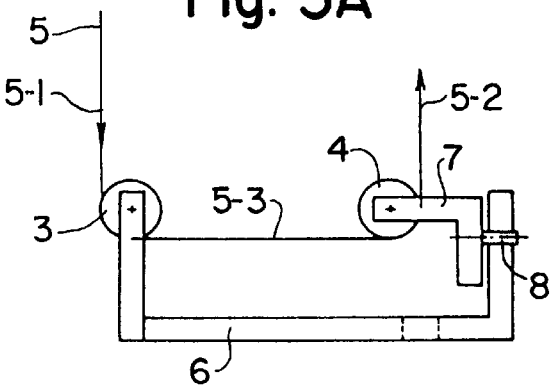
FIGS. 3(A) through 6(B) are drawings which generally illustrate the configuration and function of an example of a cloth strip traveling direction changing apparatus according to the present invention.

FIG. 3(A) shows a side view of one example of a cloth strip traveling direction changing apparatus 2 according to the present invention, in which the rotational axis $\mathbf{0}_1$ of the introduction guide roller 3 is rotatably supported by the frame 6, the rotational axis $\mathbf{0}_2$ of the withdrawal guide roller 4 being rotatably supported by the sub-frame 7, this sub-frame 7 being further pivotably mounted to the frame 6 via a pivot pin 8.

In the above-noted example, by causing the above-noted sub-frame 7 to pivot about a center which is the pivot pin 8, the rotational axis $\mathbf{0}_2$ of the withdrawal guide roller 4 can be freely set an arbitrary angle with respect to the rotational axis $\mathbf{0}_1$ of the introduction guide roller 3.

Figure 3B:
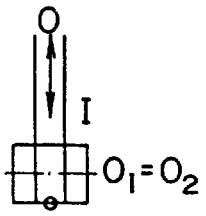

FIG. 3(B) shows the positional relationship between the rollers 3 and 4 and the above-noted pivot pin 8, as seen from the direction of the arrow D.

That is, in FIG. 3(A) the rotational axis $\mathbf{0}_1$ and $\mathbf{0}_2$ of the introduction guide roller 3 and the withdrawal guide roller 4, respectively, are oriented in the same direction, there being no relative angle difference existing between the rotational axes $\mathbf{0}_1$ and $\mathbf{0}_2$ of the introduction guide roller 3 and withdrawal guide roller 4, respectively, so that in this case the cloth strip 5 receiving the associated processing can have its traveling direction changed by 180 degrees, without imparting to it any twist.

Figure 4A:
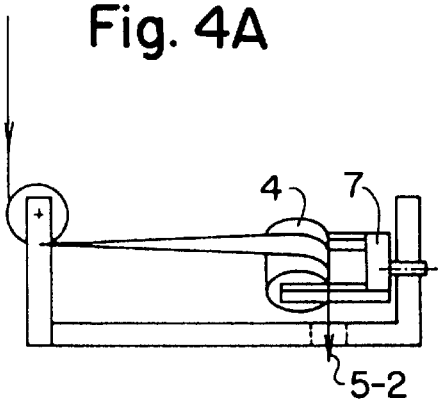

In FIG. 4(A) is shown the example in which the above-noted sub-frame 7 is pivoted by 45 degrees about the pivot pin 8 so that the rotational axis 02 of the withdrawal guide roller 4 is maintained at a relative angle of 45 degrees with respect to the rotational axis $\mathbf{0}_1$ of the introduction guide roller 3.

Figure 4B:
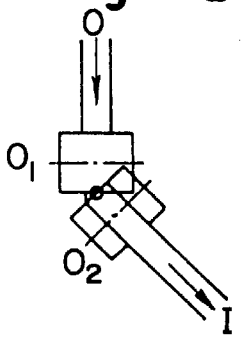

FIG. 4(B) shows the positional relationship between the rollers 3 and 4 and the above-noted pivot pin 8, as seen from the direction of the arrow D.

In this case, therefore, it is possible to change the traveling direction of the cloth strip 5-1 from the traveling direction I, which is the direction governed by the introduction guide roller 3, to the traveling direction 0, which is the direction governed by the withdrawal guide roller 4, shifted 45 degrees with respect to the traveling direction I.

Figure 5A:
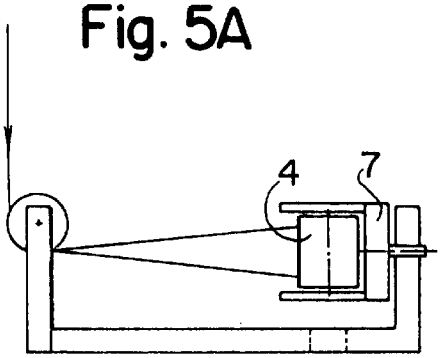
Figure 5B:
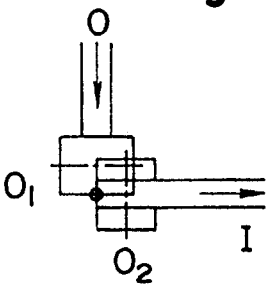

FIG. 5(A) shows an example in which the above-noted sub-frame 7 is pivoted by 90 degrees about the pivot pin 8, so that the rotational axis $\mathbf{0}_2$ of the withdrawal guide roller 4 is maintained at a relative angle of 90 degrees with respect to the rotational axis $\mathbf{0}_1$ of the introduction guide roller 3.

In this case, therefore, it is possible to change the traveling direction of the cloth strip 5-1 from the traveling direction I, which is the direction governed by the introduction guide roller 3, to the traveling direction 0, which is the direction governed by the withdrawal guide roller 4, shifted 90 degrees with respect to the traveling direction I.

Figure 6A:
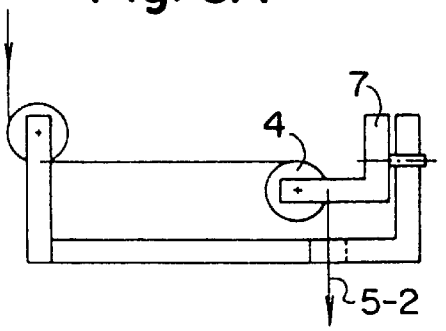
Figure 6B:
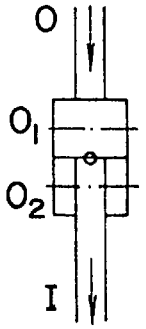

FIG. 6(A) shows an example in which the above-noted sub-frame 7 is pivoted by a further 90 degrees about the pivot pin 8, so that the rotational axis $\mathbf{0}_2$ of the withdrawal guide roller 4 is maintained at a relative angle of 180 degrees with respect to the rotational axis $\mathbf{0}_1$ of the introduction guide roller 3.

In this case, therefore, although this is similar to the case shown in FIG. 3(A), the cloth strip 5-1 is withdrawn to the direction 0, which is the same as the direction I governed by the introduction guide roller 3, only the traveling position of the cloth strip is changed.

Thus, in the present invention by suitably providing the above-noted cloth strip traveling direction changing apparatus 2 either within each of the processing sections or between the processing sections which make up the plurality of continuous linked processing zones in the continuous cloth strip processing apparatus, it is possible not only to change the continuous traveling direction of the cloth strip in each of the processing sections, but also, even within one and the same processing section, to arbitrarily change the traveling direction or traveling position of the cloth strip.

That is, in the present invention, one or more of the above-noted cloth strip traveling direction changing apparatus 2 is provided at the input section K-1 or output section K-2 of each of an arbitrarily selected plurality of processing sections from among the plurality of processing sections 1A through 1E shown in FIG. 1, the relative angle between the rotational axes $\mathbf{0}_1$ and $\mathbf{0}_2$ of the introduction guide roller 3 and withdrawal guide roller 4 in this cloth strip traveling direction changing apparatus 2 being arbitrarily set, thereby enabling an arbitrary setting of the traveling direction or traveling path of the cloth strip 5 between processing sections.

In the above-noted cloth strip traveling direction changing apparatus 2 of the present invention, as shown in FIG. 2 and FIG. 7, the introduction traveling surface S1 of the cloth strip 5-1 which is introduced at the introduction guide roller 3 and the withdrawal traveling surface S2 of the cloth strip 5-2 which is withdrawn by the withdrawal guide roller 4 are set at mutually differing plane positions, the changing-angle traveling surface S3 which is formed by the cloth strip 5-3 that runs between the introduction guide roller 3 and the withdrawal guide roller 4 is set so as to cut across the introduction traveling surface S1 and withdrawal traveling surface S2 of the cloth strip 5 at an arbitrary angle.

While in the present invention it is possible, as described above, to arbitrarily set the relative angle θ between the rotational axes $\mathbf{0}_1$ and $\mathbf{0}_2$ of the introduction guide roller 3 and withdrawal guide roller 4 of the cloth strip traveling direction changing apparatus 2 in the present invention, the inventor, having learned that there is an intimate relationship between the spacing between the introduction guide roller 3 and the withdrawal guide roller 4 and the relative angle θ between the rotational axes $\mathbf{0}_1$ and $\mathbf{0}_2$ of the introduction guide roller 3 and the withdrawal guide roller 4 which is formed by causing at least one of the rollers 3 and 4 to pivot, performed the experiment described below for the purpose of examining the relationship in which obtaining a large relative angle θ with a short spacing between the two rollers 3 and 4 has an adverse effect on the characteristics of the cloth strip product.

In a cloth strip traveling direction changing apparatus 2 configured as shown in FIG. 7(A) and FIG. 7(B), if the configuration is such that, as shown in FIG. 7(C), the introduction guide roller 3 is held fixed and the rotational axis $\mathbf{0}_2$ of the withdrawal guide roller 4 is arbitrarily pivoted, an investigation was performed to determine, for a cloth strip of width X and a axis-to-axis distance of Y between the two guide rollers 3 and 4, what kind of influence is given on the product characteristics by the cloth strip being twisted as it moves along.

Prerequisite conditions for the above investigation were that the rotational axis $\mathbf{0}_1$ of the introduction guide roller 3 was set to be perpendicular to the traveling axis $X_1$ of the cloth strip 5 (5-1) that arrives at roller 3 and further that the roller is making a surface contact with the cloth strip at one side.

The contact angle between the cloth strip and the introduction guide roller 3 can be set arbitrarily within 180 degrees. Additionally, the withdrawal guide roller 4 is installed to be on in contact with the opposite surface of the cloth strip from the surface of the cloth strip making contact with the introduction guide roller 3.

The rotational axis $\mathbf{0}_2$ of the withdrawal guide roller 4 can be arbitrarily oriented to be anywhere from parallel to the rotational axis $\mathbf{0}_1$ of the introduction guide roller 3 to a maximum of 90 degrees with respect thereto.

In the case in which the relative angle θ between the rotational axes $\mathbf{0}_1$ and $\mathbf{0}_2$ of the introduction guide roller 3 and the withdrawal guide roller 4, respectively, is set to be 90 degrees, the length between the ends of the cloth strip which runs while twisting between the introduction guide roller 3 and the withdrawal guide roller 4 was determined by calculating Z, and an observation was made of the relationship of this to the width X of the cloth strip 5, and to the axis-to-axis distance Y between the introduction guide roller 3 and the withdrawal guide roller 4.

Figure 8A:
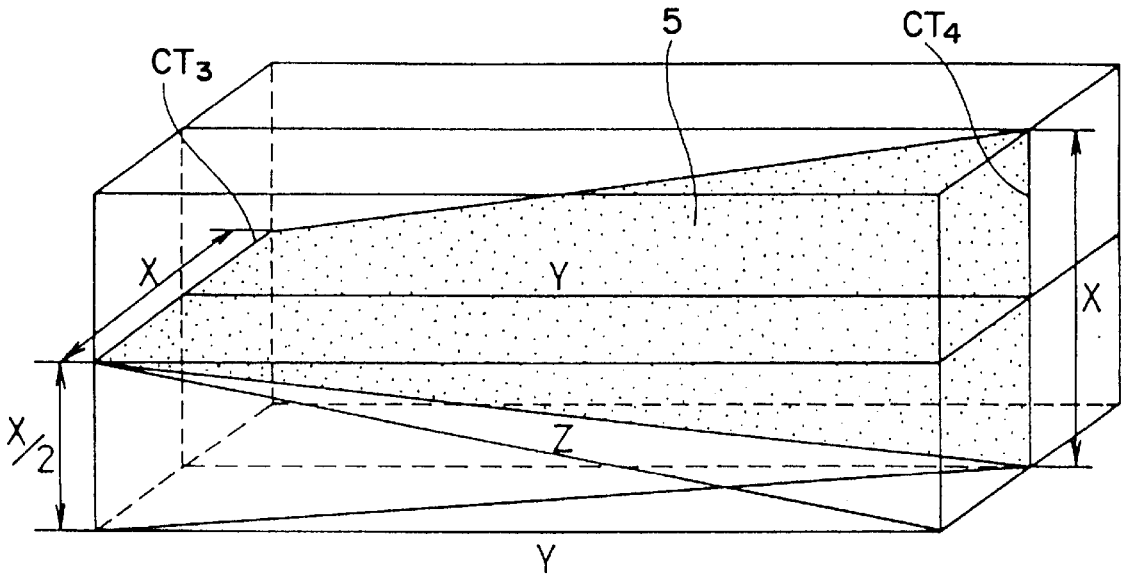
FIGS. 8(A) and 8(B) are drawings which illustrate the configurational conditions of the cloth strip traveling direction changing apparatus according to the present invention.
Figure 8B:
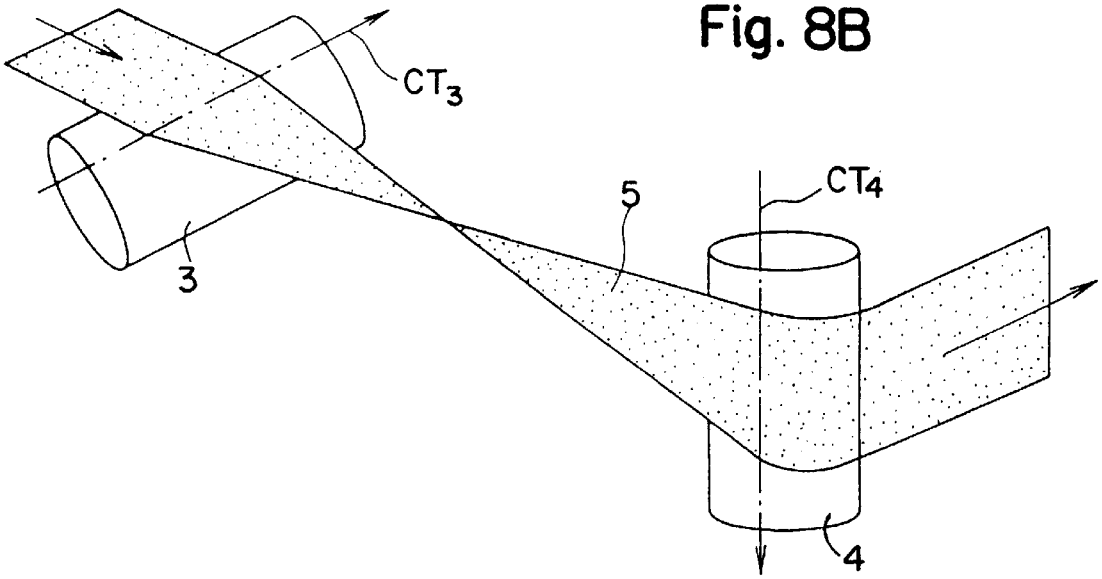

The length Z between ends of the cloth strip, as can be seen from FIG. 8(A) and FIG. 8(B), is the hypotenuse of the right triangle ABD which has ½ the width X of the cloth strip as a side. An investigation was made of the relationship between the distance Y between the points of contact of the cloth strip with the introduction guide roller 3 and with the withdrawal guide roller 4 being the base of the right triangle ABC, which has ½ the width X of the cloth strip as a side and the distance Z between the points of contact of the edge at one side, of the cloth strip with the introduction guide roller 3 and with the withdrawal guide roller 4, the results being presented in Table 1.

Specifically, the ratio of the distance Z at the edge of the cloth strip to the distance Y at the center part thereof is such that the smaller the valve is in the interval between the introduction guide roller 3 and the withdrawal guide roller 4, that is, the smaller the distance Y is in relation to the width X of the cloth strip, the greater is the extension in length of the edge of the cloth strip with relation to the length of the center part of the cloth strip.

It has been found by prior experience that in order for the distortion, which is dependent upon the difference in length of the edge part with respect to the length of the center part of the cloth strip, to naturally correct itself so, that there is no affect on the structure and performance of the cloth strip, it is desirable that the distortion be 2.8% or less.

Figure 9:
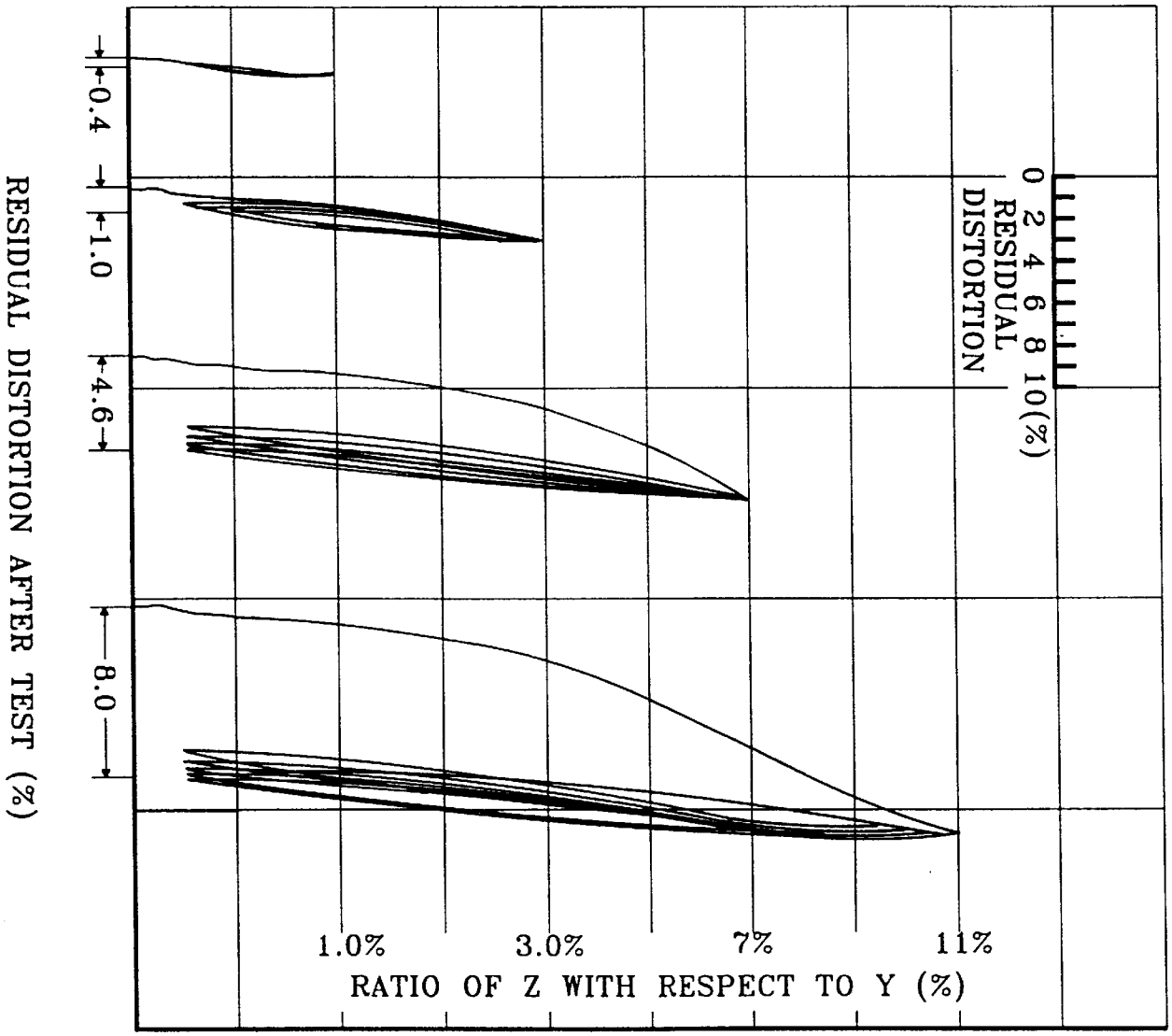
FIG. 9 is a graph which illustrates the influence of residual distortion of the cloth strip by the cloth strip traveling direction changing apparatus according to the present invention.

For the purpose of investigating the conditions for limiting this distortion to, for example, less than 2.8%, an experiment was performed in which the above-noted cloth strip traveling direction changing apparatus 2 according to the present invention was used, the relative angle between the rotational axes $\mathbf{0}_1$ and $\mathbf{0}_2$ of the above-noted introduction guide roller 3 and withdrawal guide roller 4, respectively, being suitably varied, and in which the relationship of the ratio of the distance Z between the part of the above-noted two rollers in contact with the edge part of the cloth strip and the distance Y between the two points of contact of the cloth strip with the rollers and the residual distortion of the cloth strip was determined, the results being shown in FIG. 9.

As can be judged from the results of this experiment, as the ratio of the distance Z between the part of the two rollers in contact with the edge part of the cloth strip becomes large with respect to the distance Y between the contact points, the residual distortion becomes large, it being seen that, to make the residual distortion 2.8% or less, it is necessary to make the ratio of the distance Z between the part of the rollers in contact with the edge part of the cloth strip with respect to the distance Y between the contact points 3% or less.

Comparing this condition to the relationship shown in Table 1, it can be seen that if the distance Y between the contact points of the cloth strip with the introduction guide roller 3 and the withdrawal guide roller 4 is 3 times the width X of the cloth strip, it is possible to prevent the distortion of the cloth from affecting the quality of the cloth strip.

Therefore, in the present invention, it is seen that, in order that the distance Y between the contact points of the center of the width of the cloth strip with the introduction guide roller 3 and the withdrawal guide roller 4 be 3 times the width X of the cloth strip, it is necessary that the distance Z between the contact points of the rollers with the edge parts of the cloth strip be 1.0274 or less times the distance Y between the contact points of the center of the width of the cloth strip with the rollers.

That is, based on the above-described investigation, in the present invention when the relative angle θ between the rotational axes $\mathbf{0}_1$ and $\mathbf{0}_2$ of the introduction guide roller 3 and withdrawal guide roller 4, respectively, which form the traveling direction changing apparatus 2, is varied arbitrarily, so that the angled traveling surface S-3 is formed as the cloth strip 5 is twisted as the cloth strip is caused to travel, the distance between the rollers is set so that the distance Y between the contact point of the introduction guide roller 3 with the center of the width X of the cloth strip and the contact point of the withdrawal guide roller 4 with the center of the width X of the cloth strip is 3 or more times the width X of the cloth strip.

At the angled traveling surface S-3 which is formed in the cloth strip as it travels between the two rollers of the cloth strip traveling direction changing apparatus 2, in the case in which the relative angle between the rotational axes of the two rollers is 90 degrees, the relationship of the distance Y between the contact points of the rollers with the center line with respect to the cloth strip to the distance Z between the contact points of the rollers with the edge parts of the cloth strip is calculated to be as shown in Table 1.

For example, when the cloth strip center-line distance Y is 4 times the cloth strip width X, the distance Z between edge parts is 1.0155 times Y, indicating that the edge part of the cloth strip is elongated approximately 1.5% with respect to the part at the center line.

In the same manner, if Y is 3 times X, Z is 1.0274 times Y, indicating that the edge part of the cloth strip is elongated approximately 2.7%, if Y is 2.25 times X, Z is 1.0482 times Y, indicating that the edge part of the cloth strip is elongated approximately 4.8%, and if Y is 2 times X, Z is 1.0607 times Y, indicating that the edge part of the cloth strip is elongated approximately 6.0%.

FIG. 9 shows the residual distortion of a general type of belt-like cloth strip 200 mm long made of polyester synthetic fiber, when the prescribed elongation distortion is imparted to it 10 times at normal room temperature by a tensile-testing machine. The pulling speed was 100 mm/min. and the residual distortion was amplified 2.5 times. Thus, with the distance between marked points being 200 mm, residual distortion can be found as:

Residual Distortion=(Chart value (mm)/2.5/200 mm×100%).

For example, in the case in which the elongation distortion of the cloth strip is 1% of the original length, the residual distortion of the cloth strip is approximately 0.4%.

In the same manner, in the case in which the elongation distortion is 3%, the residual distortion is approximately 1%, when the elongation distortion is 7% the residual distortion is approximately 4.6%, and when the elongation distortion is 11% the residual distortion is approximately 8%.

Therefore, it was seen that if the residual elongation distortion at the edge part of the cloth strip is approximately 1% or less with respect to the center part thereof, there is no influence by the distortion on the outer appearance and performance of the cloth strip.

It was also seen that when the residual elongation distortion in the cloth strip exceeds 1%, the edges of the cloth strip can become wavy or twisted, and when the residual distortion exceeds 4.6%, the cloth strip can become extremely distorted, to the extent that its value as a belt-like product is completely lost.

Based on these experiments and observations, it was verified as a result of processing many belt-like products by passing them through the cloth strip traveling direction changing apparatus 2 with a relative angle of 90 degrees and at various distances Y between contact points, that the ideal condition necessary as not to affect the outer appearance and performance of the traveling cloth strip is to have the distance Y between contact points with the center line part,along the width of the cloth strip be at least 3 times the width X of the cloth strip, that is, to have the elongation distortion be 1.0274 or less times the distance Y.

In the present invention, while it is possible to have one of the introduction guide roller 3 and the withdrawal guide roller 4 either be a single ganged feed roller which has a group of roller sections which are fixed to one roller shaft over which a plurality of cloth strips can travel simultaneously, or be a divided roller having a roller section that is divided into a plurality of divisions which are freely rotatable with respect to a single rotating shaft, it is necessary that at least the other roller be a single roller over which a single cloth strip travels.

In the present invention, while it is possible to make the above-noted introduction guide roller 4 and withdrawal guide roller 3 as separate elements which are combined to form a cloth strip traveling direction changing apparatus 2, it is also possible, for more efficiency, as shown in FIG. 3, to configure a cloth strip traveling direction changing roller unit by integrating as one an introduction guide roller 3 and a withdrawal guide roller 4, and to combine as appropriate a plurality of such units.

In the present invention, to improve the ease of passing the cloth strip 5 through each of the various processing zones, it is desirable to hold either the introduction guide roller 3 or the withdrawal guide roller 4 in cantilever fashion as a rotating roller, as shown in FIG. 10.

In this case, an example of the construction of the cloth strip traveling direction changing apparatus 2 is as shown in FIG. 10, in which the end of a rotating support shaft 11 of at least either the introduction guide roller 3 or the withdrawal guide roller 4 is supported by linking it to a cam section 13 which can slide within a slot 12 of an suitably provided frame 6, the relative angle between the rotational axes $\mathbf{0}_1$ and $\mathbf{0}_2$ of the introduction guide roller 3 and the withdrawal guide roller 4, respectively, being arbitrarily settable within this unit-type configuration 9.

In the present invention, an example of a cloth strip traveling direction changing apparatus 2, as shown in FIG.

11, is a cloth strip traveling direction changing apparatus in which a plurality of the units 9 are arranged in parallel or series on a base plate 14.

In this cloth strip traveling direction changing apparatus 2, the units 9, 9', 9" and so on that are arranged on one and the same base plate 14 with the rotating shaft of at least one of the introduction guide roller 3 and the withdrawal guide roller 4 of each of the units 9, 9', 9" and so on can be positioned with a pre-established relative angle with respect to the other guide roller, and it is also possible to have the units 9, 9', 9" and so on arranged, as shown for example in FIG. 3 and in FIG. 10, with at least one of the introduction guide roller 3 and the withdrawal guide roller 4 constructed so as to allow it to pivot.

Figure 12:
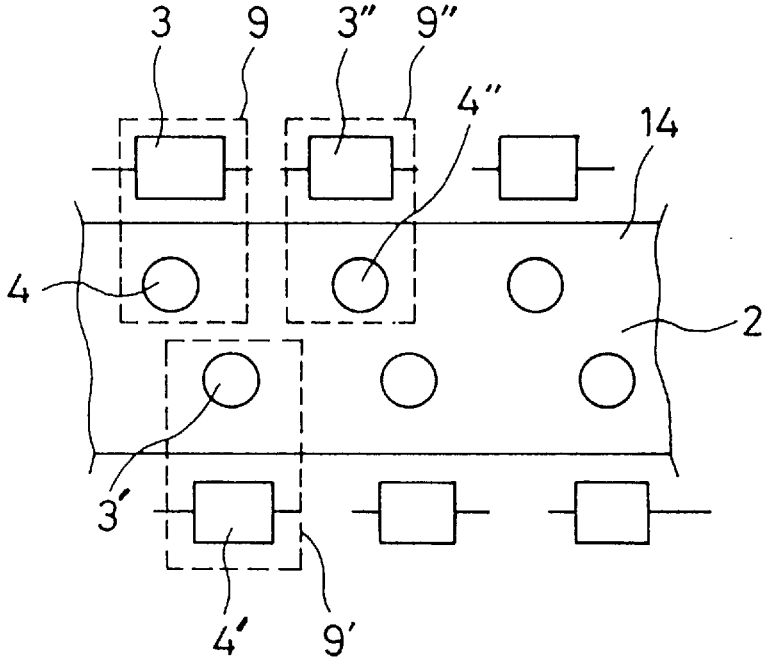
FIG. 12 is a drawing which shows another example of a form of use of a cloth strip traveling direction changing apparatus according to the present invention.

In addition, another possible example of the configuration of the cloth strip traveling direction changing apparatus 2 according to the present invention is as shown in FIG. 12, in which both the introduction guide roller 3 and the withdrawal guide roller 4 in each of the units 9, 9', 9" and so on which are arranged on the base plate 14 are arranged so that their rotational axes, such as the introduction guide roller 3', and the withdrawal guide rollers 4 and 4", are perpendicular with respect to the surface of the base plate 14, in which case the upper guide rollers shown in FIG. 12 play the role of the withdrawal guide rollers 4 and the lower guide rollers shown in FIG. 12 play the role of the introduction guide rollers 3.

Figure 13:
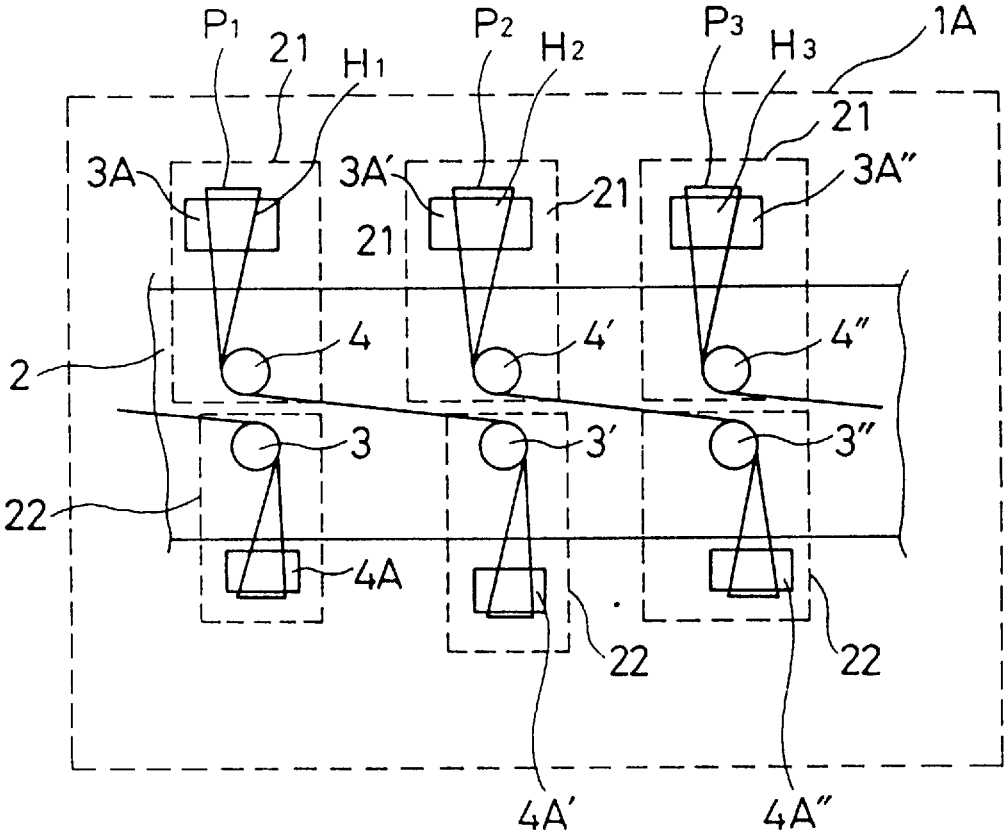
FIG. 13 is a drawing which shows yet another example of a form of use of a cloth strip traveling direction changing apparatus according to the present invention.

In this method of using the above-noted cloth strip traveling direction changing apparatus 2, for example at either the exit part or within a processing section 1A of a processing zone 1-1 of a continuous plurality of zones for processing a cloth strip, such as shown in FIG. 1, an above-noted cloth strip traveling direction changing apparatus 2 which is shown in FIG. 12 is located between the introduction guide rollers 3A, 3A', 3A" and so on and the withdrawal guide rollers 4A, 4A', 4A" and so on shown in FIG. 13. As a result, in this specific example, between the above-noted introduction guide rollers 3A, 3A', 3A" and so on and the plurality of withdrawal guide rollers 4 in this cloth strip traveling direction changing apparatus 2, a plurality of cloth strip traveling direction changing apparatuses 21 of the present invention are formed, and a cloth strip traveling direction changing apparatus 22 of the present invention is formed between the plurality of introduction guide rollers 3 and the withdrawal guide rollers 4A, 4A', 4A" and so on in this cloth strip traveling direction changing apparatus 2.

In the manner described above, in this example of the present invention, a group of two units makes up the cloth strip traveling direction changing apparatus 2.

That is, it can be envisioned that the cloth strip traveling direction changing apparatus 2 according to the present invention is formed by various combinations, including a unitized configuration, it being possible not only to dispose these combinations suitably within or outside of the processing zones, but also to freely change, as necessary, the traveling direction and traveling angle of the cloth strip by changing the angle of the rotating shaft of at least one introduction guide roller 3 and the withdrawal guide roller 4.

In the present invention, therefore, as shown in the example of FIG. 1, it is possible to use a suitable number of the cloth strip traveling direction changing apparatus 2, locating them with suitable orientations in suitable positions within or between a plurality of processing zones selected from the group of a plurality of processing zones, thereby enabling continuous feed of the cloth strip traveling between or within the processing zones, while the traveling direction is arbitrarily changed in the backward/forward, left/right and up/down directions.

Next, a detailed comparison will be made between the continuous method of processing a cloth strip in the past with an example of using the cloth strip traveling direction changing apparatus 2 according to the present invention to perform prescribed processing by causing a cloth strip 5 to travel by a plurality of processing zones in series.

Figure 14:
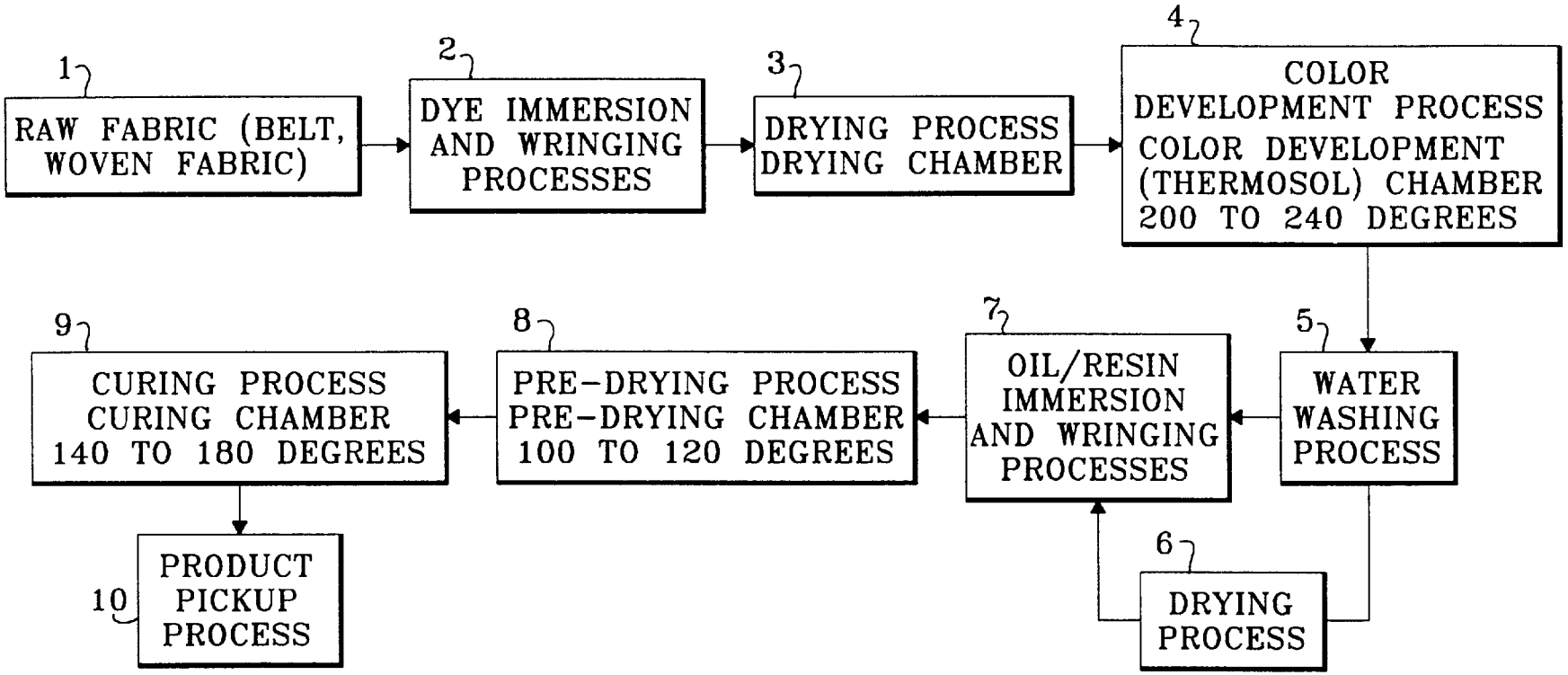
Fig. 14 (PRIOR ART)
FIG. 14 is a block diagram which shows an example of the process sequence in a continuous cloth strip processing apparatus in the past.
Figure 15A:
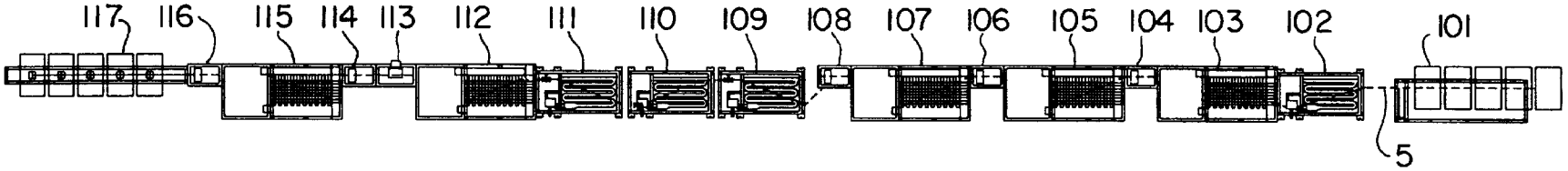
Fig. 15A PRIOR ART
FIG. 15 is a drawing which illustrates in detail an example of the processing in a continuous cloth strip processing apparatus in the past, FIG. 15(A) being a plan view, and FIG. 15(B) being a side view.
Figure 15B:
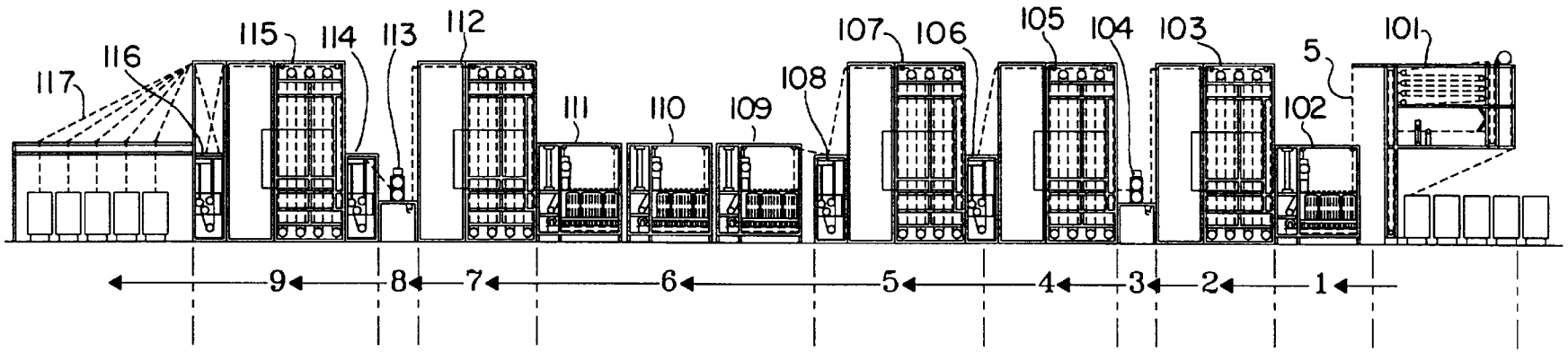
Fig. 15B PRIOR ART

FIG. 15 shows a general view of an example of a continuous processing line for a general type of woven cloth strip made mainly of a polyester synthetic fiber, providing more detail than in FIG. 14, FIG. 15(A) being a plan view thereof, and FIG. 15(B) being a side elevation view thereof.

As shown in FIG. 15, the cloth strip 5 to be processed is supplied from the cloth entrance apparatus 101, and travels successively to a scouring process indicated as <1>, which is a scouring processing zone comprising a scouring bath 102, and then to a scouring drying process indicated as <2>, which is a scouring drying processing zone comprising a scouring dryer 103, and then to a dye-application process indicated as <3>, which is a dye-application processing zone comprising a dye padder unit 104, at which a prescribed dye is applied thereto, after which it passes by a pre-drying processing as <4>, which is a pre-drying processing zone comprising a pre-dryer 105. Thereafter, the cloth strip 5 passes a color-developing (thermosol) process indicated as <5>, which is a color-developing processing (thermosol) zone comprising a metal pre-mangle 106, a thermosol setter 107, and a metal post-mangle 108 performing the prescribed dye color-developing processing. After which the cloth strip 5 passes a water-washing process indicated as <6>, which is a three-stage water-washing processing zone comprising first, second, and third water-washing baths 109, 110, and 111, respectively. Then, the cloth strip 5 enters a post-water-washing drying process indicated as <7>, which is a water-washing drying processing zone comprising a water-washing dryer 112. After which it passes a finishing agent application process indicated as <8>, which is a finishing agent pad zone comprising an oil resin padder unit 113. Then which it passes sequentially by a final heat setting process indicated as <9>, which is a finishing agent drying and heat setting processing zone comprising, in sequence, a metal pre-mangle 114, a heat setter 115 and a metal post-mangle 116. Finally, the cloth strip 5 is stored as a final product in a cloth output apparatus 117.

Figure 16:
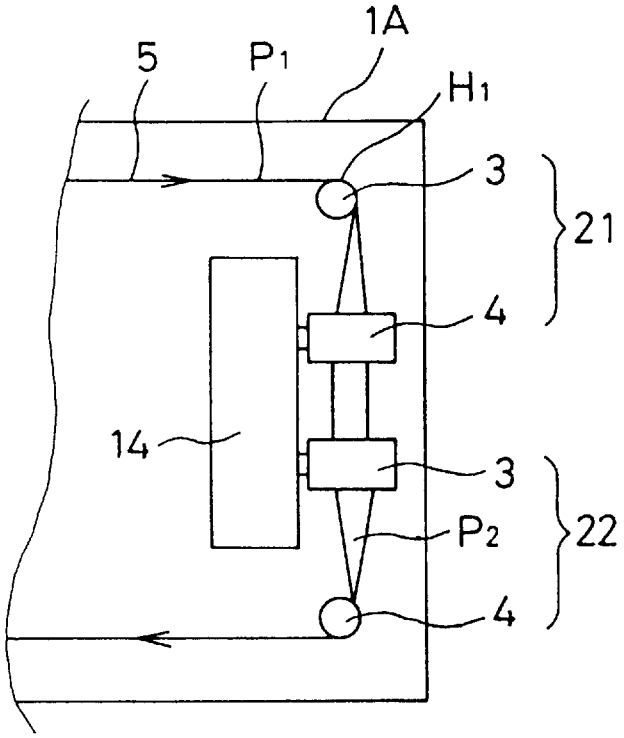
FIG. 16 is a drawing which illustrates an example of using a cloth strip traveling direction changing apparatus according to the present invention at an arbitrary processing zone in a continuous processing apparatus.

That is, in continuous cloth strip processing in the past, all the processing zones are arranged along a straight line. The cloth strip travels along these processing zones in an approximately straight line so as to pass by each of the processing zones. The overall length of the continuous cloth strip processing apparatus 1 could be, for example, 40 meters Additionally, as noted above, because multiple processing zones having the same type of function are provided, the working efficiency is worsened, and extra energy is consumed, thereby causing an increase in production cost, In contrast to the above-noted system, the present invention makes effective use of the above-noted cloth strip traveling direction changing apparatus 2. Referring to FIG. 13 and FIG. 16, if, for example, in a continuous cloth strip processing apparatus 1 in which at least one long cloth strip 5 is continuously passed by a plurality of processing zones so as to receive the prescribed processing at each of the processing zones, it is possible, within at least one processing section 1A that makes up the continuous cloth strip processing apparatus 1, to have the cloth strip 5 pass by the traveling direction changing points H1 H2, H3 and so on as it forms a plurality of traveling paths P1, P2, P3 and so on to receive the prescribed processing. The cloth strip can pass along the traveling path P1 within the processing section 1A with one cloth strip traveling direction changing apparatus 21 being provided at the traveling direction changing point H1 at which the traveling direction of the cloth strip 5 is to be changed, and an additional cloth strip traveling direction changing apparatus 22 being provided at the point at which the cloth strip 5 is next caused to enter the adjacent traveling path P2. The result being that the cloth strip 5 travels sequentially along the mutually parallel traveling paths P1, P2, P3, and so on.

In the abovenoted configuration, it is possible, for example, to have the cloth strip take any number of round trips in a spiral or zig-zag configuration within a processing section that forms a processing zone, thereby not only enabling a shortening of the required length of the processing section, but also enabling the cloth strip to be processed by passing through the same processing section a number of times, so that even a cloth strip that has continued on to be processed at a different or second processing zone can be returned to pass through that first processing section once again.

This ability means that it is possible to use conditions that are set in one processing section with a prescribed purpose in the processing of the same cloth strip for a different purpose, thereby enabling multi-purpose use of a single processing zone, which contributes greatly to a savings of energy.

In addition, because the inside of a processing section forming a single processing zone is divided into a plurality of processing chambers, it is possible to cause the processing condition of each of these processing chambers to be mutually different. This provides a higher level of freedom than in the above-described example and enables execution of different processing on one and the same cloth strip.

Figure 17:
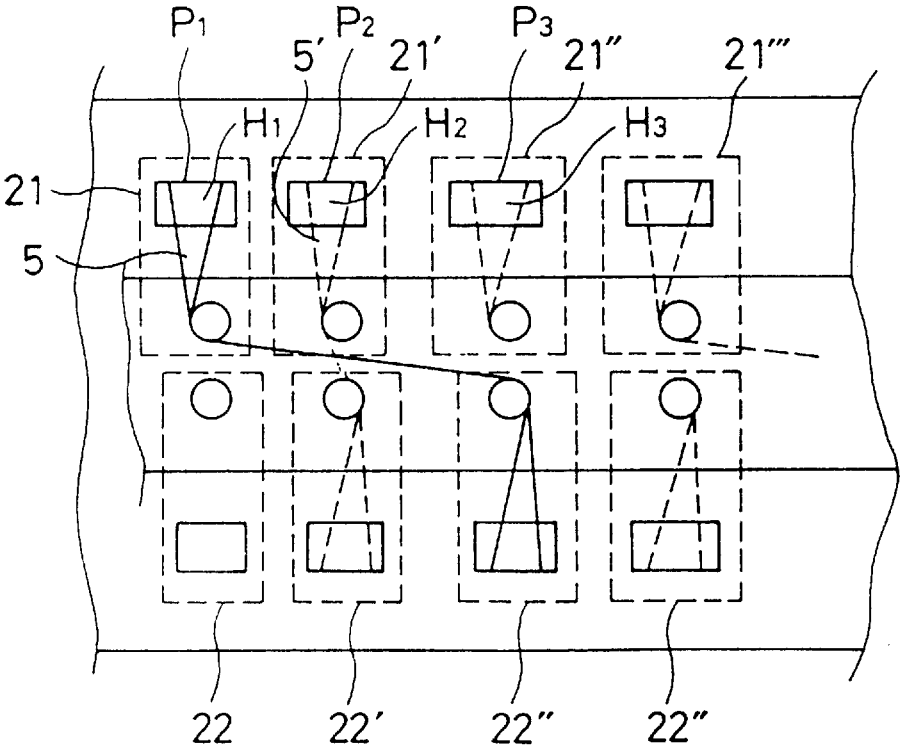
FIG. 17 is a drawing which illustrates another example of using a cloth strip traveling direction changing apparatus according to the present invention at an arbitrary processing zone in a continuous processing apparatus.

In the present intention, as shown in FIG. 17, within at least one processing section 1A of a plurality of processing sections, in passing the cloth strip 5 by the traveling path changing points H1, H2, H3 and so on, the cloth forms a plurality of traveling paths P1, P2, P3 and so on, and receives the prescribed processing after passing by one selected traveling path P1 inside this processing section 1A. One cloth strip direction changing apparatus 21 is provided at the traveling path changing point H1 where the cloth strip is to enter the path P1, and an additional cloth strip direction changing apparatus 22" is provided at the point at which the cloth strip 5 is to enter another selected traveling path P3, the result being that the cloth strip 5 travels along an arbitrary path within one and the same processing section 1A in mutually parallel fashion.

While in the configuration of the above-noted continuous cloth strip processing apparatus the same cloth strip 5 is in a given single processing such as zone 1-1, it is also possible to return or re-send the cloth strip back to zone 1-1 after processing at a different processing zone, such as the processing zone 1-3 shown in FIG. 1.

That is, in the above-noted example, in the plurality of traveling paths, it is possible to have in this processing section, mixed with and in addition to a cloth strip which receives the prescribed processing at the above-noted processing section, a cloth strip which has already been passed through this processing section and which has received the prescribed processing at a different processing zone, to receive the same processing or to receive processing for a different purpose.

For this reason, it is possible to configure the present invention so that a cloth strip is continuously passed through and processed by a plurality of processing zones. The sequence of processing sections making up the continuous cloth strip processing apparatus is different from the sequence in which the cloth strip passes continuously through the processing section.

Figures 18A, 18B:
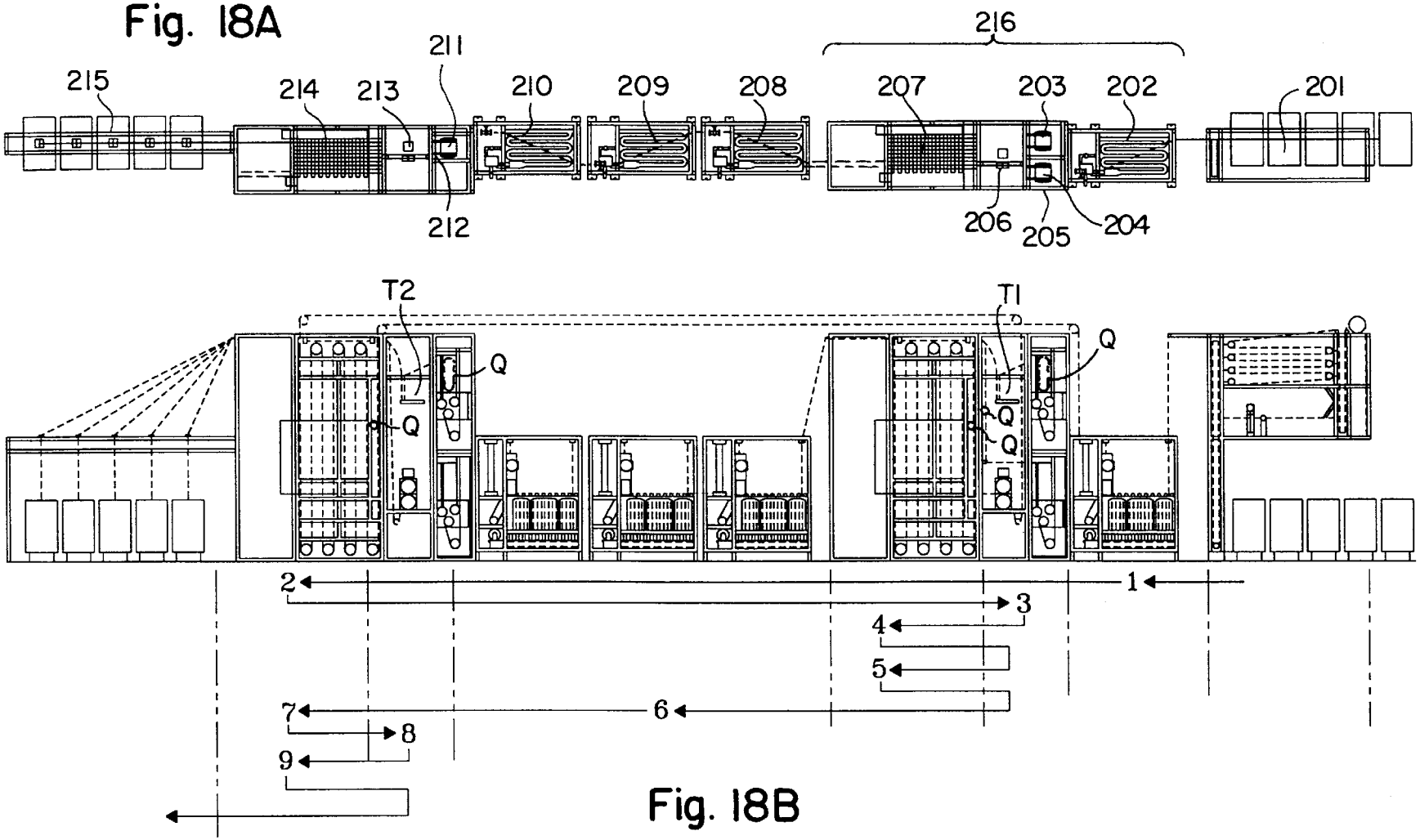
FIG. 18 is a drawing which shows the configuration of an example of a continuous processing apparatus according to the present invention, FIG. 18(A) being a plan view, and FIG. 18(B) being a side view.

For example, FIG. 18(A) and FIG. 18(B), are plan and elevation views, respectively, of a continuous cloth strip processing apparatus according to the present invention. In this apparatus, starting from the right side of the drawing, the apparatus comprises a cloth entrance apparatus 201, a scouring bath 202, a dye padder unit 206 which comprises an integrated combination of a metal pre-mangle 205, a metal post-mangle 203, and a cooking unit 204 (this dye padder unit 206 comprising a dye bath and a general squeezing roller), a pre-dryer/thermosol setter 207, three stages of water washing comprising the first, second, and third water baths 208, 209, and 210, respectively, an integrated oil padder unit 213 comprising a metal pre-mangle 211 and a metal post-mangle 212 (this oil padder unit 213 comprising an oil bath and a general squeezing roller), an integrated scouring drying/washing drying/heat setter 214, and a cloth exit apparatus 215.

In the present invention in performing the prescribed processing on the cloth strip 5 in a continuous cloth strip processing apparatus 1, as shown by the traveling path indicated at the bottom of the FIG. 18(B), the cloth strip is first supplied from the cloth entrance apparatus 201 and then processed by the scouring bath 202 which forms the scouring drying processing zone indicated as <1>, after which it is supplied to the integrated processing bath 214 which forms the washing/drying region indicated as <2>, which comprises the scouring drying/washing drying/heat setter. After passing by the scouring drying processing zone of the processing bath 214, the cloth strip travels in the reverse direction by the cooling unit 204 and enters the dye padder unit 206 which from the dye-application zone indicated as <3>, at which a prescribed dye solution is applied thereto, after which it passes the pre-drying zone inside the pre-drying/thermosol setter 207 which forms the pre-drying zone indicated as <4>. Thereafter, the cloth strip 5 returns in the reverse direction to the metal pre-mangle 205, after which it again reverses direction so as to return again the same above-noted pre-dryer/thermosol setter 207 so that it is color developed (thermosol) as tension is applied thereto between the metal pre-mangle 205 and the metal post-mangle 207.

In this case, the cloth strip 5 passes through the thermosol setter zone of the above-noted pre-dryer/thermosol setter 207.

After the cloth strip 5 receives dye development processing at the processing zone <5>, the cloth strip 5 reverses once again and, passing by the metal post-mangle 203, then passes the first, second, and third water baths 208, 209, and 210, respectively, which form the three-stage water washing zone indicated as <6>. Then, the cloth strip 5 enters the processing bath 214 which is an integrated scouring drying/water washing drying/heat setter which forms the water washing zone indicated as <7>, entering the water washing drying zone thereof.

Thereafter, after the cloth strip 5 has a prescribed oil applied to it at an oil padder unit 213 which includes the metal pre-mangle 211 and the metal post-mangle 212 which forms the finishing agent padder zone indicated as <8>, the cloth strip 5 passes through the above-noted metal pre-mangle 211 and is supplied to the processing bath 214 which comprises the integrated scouring drying/water washing drying/heat setter indicated as <9>. Then, after passing through the heat setting zone of the processing bath 214, it returns to the metal post-mangle 212 which forms the finishing agent padder zone indicated as <8> and, after having a prescribed amount of tension applied to it between the metal pre-mangle 211 and the metal post-mangle 212, it is held as a final product in the cloth output apparatus 215.

Figure 19:
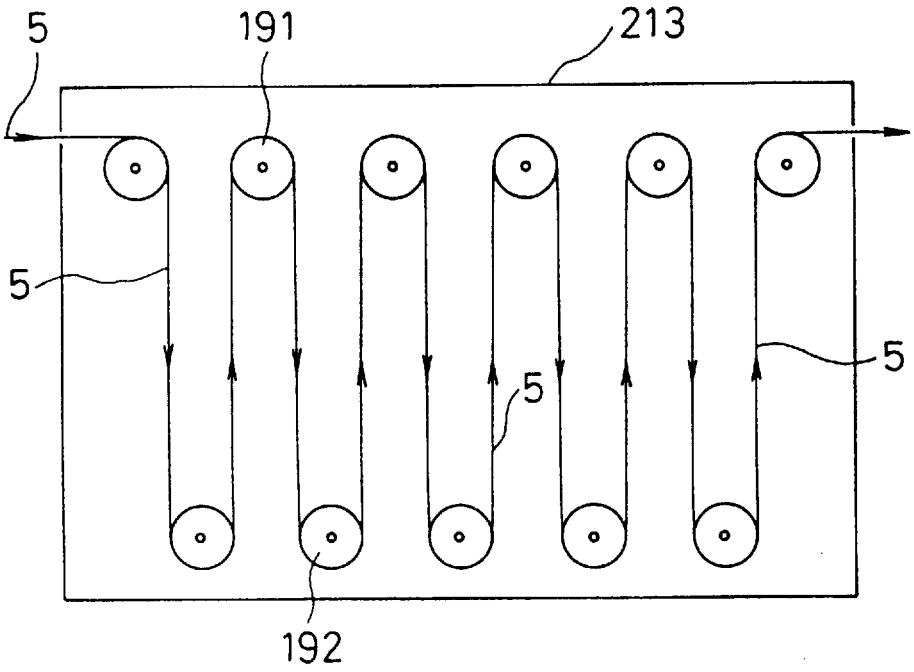
FIG. 19 and FIG. 20 are drawings which show the form of the traveling of a cloth strip in an arbitrary processing zone which is used in the continuous processing apparatus according to the present invention.
Figure 20:
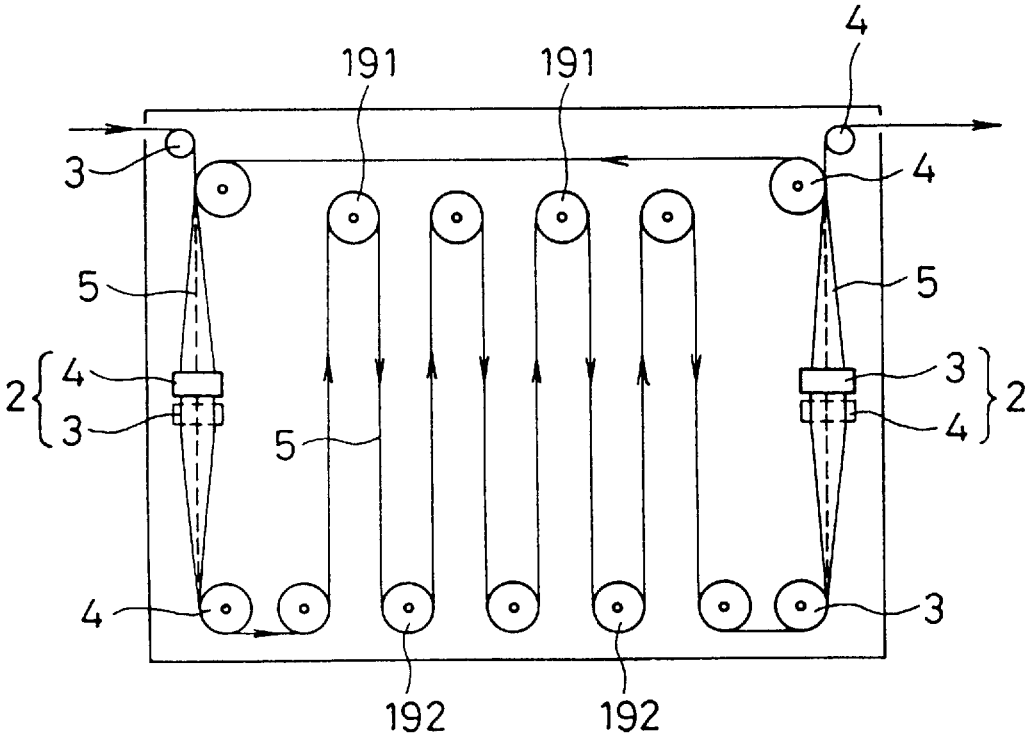

While the processing sections which are used to perform the prescribed processing in the above-noted example are basically known processing apparatuses, it is desirable for example in the scouring bath 202, or in the water washing baths 208, 209, and 210 or scouring drying/water washing drying/heat setting bath 214 to have the cloth strip 5, as shown in FIG. 19, make a zig-zag pass between a plurality of guide rollers 191 and 192 which are disposed at the top and the bottom so as to lengthen the processing time. It is also possible, as shown in FIG. 20, not only to cause the cloth strip to make a zig-zag pass between a plurality of guide rollers 191 and 192 which are disposed at the top and the bottom, but also to provide a cloth strip traveling direction changing apparatus 2 according to the present invention in part of the traveling path of the cloth strip 5, so that the cloth strip 5 is passed in a spiral configuration any number of times within one and the same processing section as the traveling path thereof is sequentially changed between adjacent traveling paths.

Figure 21A:
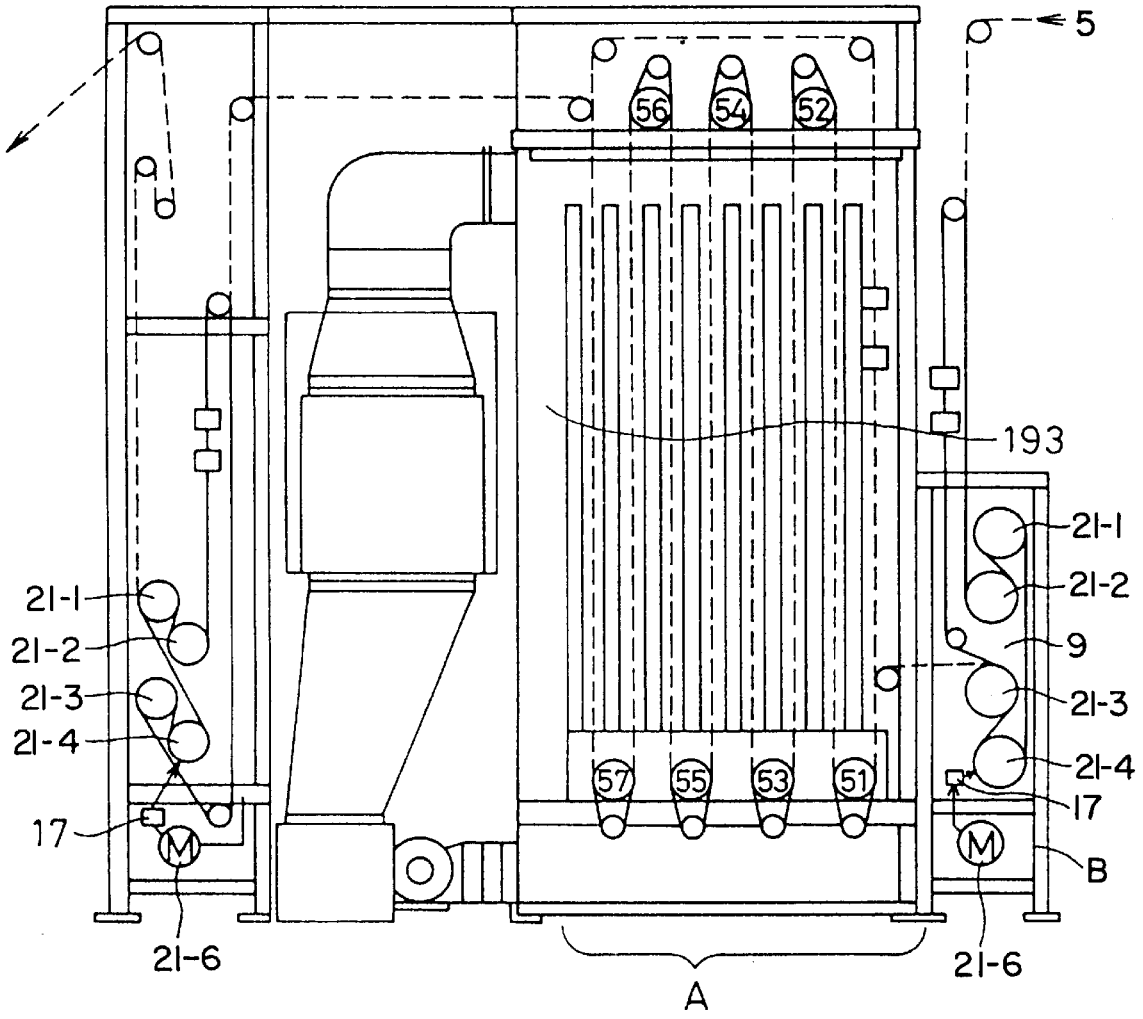
FIGS. 21(A) to 21(C) are drawings which illustrate another example of the form of traveling of a cloth strip in an arbitrary processing zone which is used in the continuous processing apparatus according to the present invention, and an example of the tension roller configuration.

In the processing baths as comprising a pre-dryer/thermosol setter 207 and the integrated scouring drying/washing drying/heat setter 214 used in the above-noted example, it is possible to use a heating apparatus such as shown at A in FIG. 21(A). That is, a plurality of heating apparatuses 193 are arranged in parallel, the cloth strip being caused to pass therebetween using guide rollers 191 and 192 such as shown in FIG. 19 or FIG. 20.

It is possible for the cooling unit 204, the metal pre-mangles 205 and 211, and the metal post-mangles 203 and 212 used in the above-noted example to be formed by a group of rollers such as shown at B or C of FIG. 21(A).

That is, it is desirable that the group of rollers (21-1 through 21-4) at B or C of FIG. 21(A) be metal rollers which have at least their surfaces made of metal, and in addition, that these four rollers 21-1 through 21-4 be disposed so as not to be in mutual contact, and also so that these metal-surfaced rollers be actively driven or braked via a suitable drive means 21-6.

Each of the metal-surface rollers 21-1 through 21-4 are caused to rotate at a prescribed rotational speed by means of a drive means having a suitable configuration, the rotating shafts of each of the metal-surfaced rollers 21-1 through 21-4 being rotated at a mutually equal speed by suitable drive transmission means 17, such as a chain, a gear, or a belt.

While it is necessary that the metal-surfaced rollers (21-1 through 21-4) of the present invention not make mutual physical contact, there is no particular limitation with regard to the spacing therebetween, this spacing being arbitrarily settable. Neither is there any particular limitation placed on the number of metal-surfaced rollers. This is necessary because of the interrelation between the configuration of the cloth strip 5 and the surface condition of the metal-surface rollers to make the design so that slippage does not occur when transporting cloth strip 5 with a prescribed tension.

While it is desirable that the above-noted metal-surfaced rollers 21-1 through 21-4 be made entirely of metal, it is also possible that only the surface part which makes contact with the cloth strip 5 be made of metal. In the present invention, the metal that forms at least the surface of the above-noted metal-surfaced rollers is desirably plated with hard chromium, and it is further desirable that the surfaces of the metal-surfaced rollers 21-1 through 21-4 be as smooth as possible and, if possible, that they be mirror finished.

Figure 21B:
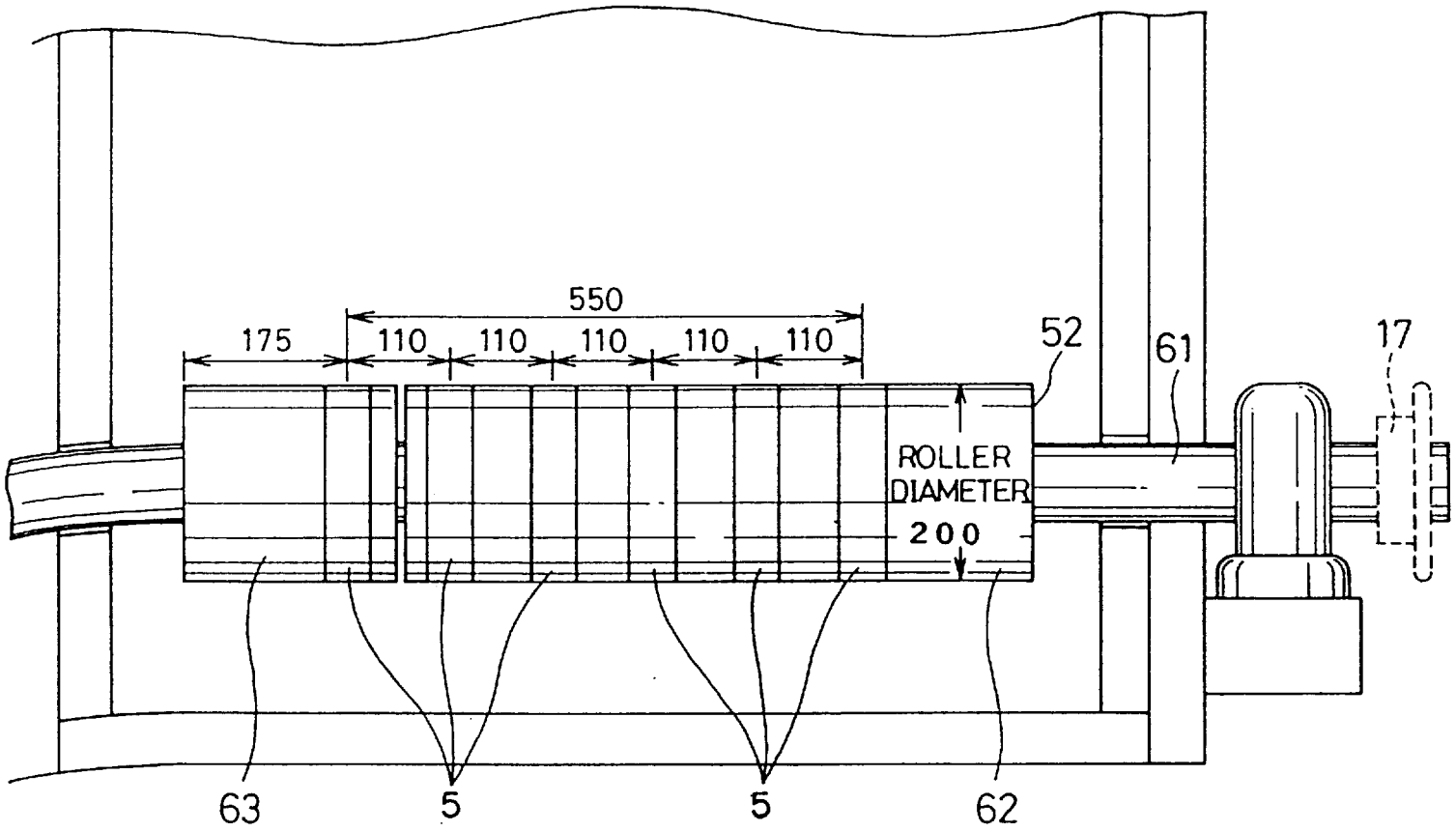
Figure 21C:
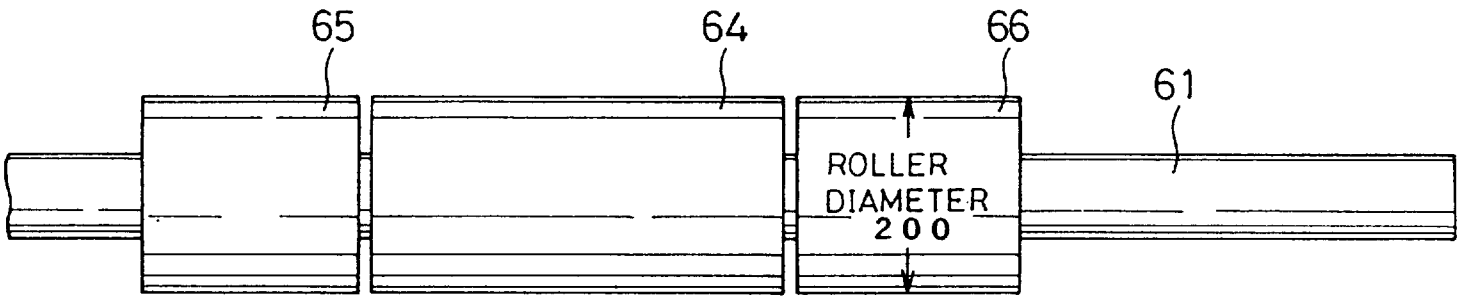

At least one part of the guide rollers 51 through 57 used in the heating apparatus 193 shown at A in FIG. 21(A) has a plurality of roller parts which are divided from one another on a single rotating shaft, as shown in FIG. 21(B) or FIG. 21(C), these being fixed to the rotating shaft of this feed roller, the configuration being made so that they can freely rotate with respect to the rotating shaft. It is also possible, if required, to have all of the divided roller parts free to rotate, or to have part of them in locking contact with respect to the shaft. It is desirable to use a configuration that permits locking contact as required with respect to the contraction and stretching behavior of various types of woven belts.

As shown in FIG. 21(B), for example, the feed roller itself is divided into at least two parts, 62 and 63, one of these parts, 62, being linked to a drive means and being provided so as to be fixed with respect to the rotating shaft 61. The other part, 63, is provided so as to be able to freely and passively rotate with respect to the rotating shaft 61.

FIG. 21(C) shows another example of dividing the above-noted passively rotatable roller, in which the roller is divided into three parts, the center part 65 being fixed with respect to the rotating shaft 61, and the parts 65 and 66 to either side thereof being passively rotatable. The length of the divisions of this roller can be arbitrarily set.

In this example of the present invention, a cloth strip traveling direction changing apparatus 2 according to the present invention is located at the part indicated by the symbol Q in FIG. 18, so that the traveling direction of the cloth strip is moved up and down, left and right, and also forward and backward (that is, including reverse feed) as the cloth strip 5 is processed.

According to the above-noted configuration, the overall length of the continuous, cloth strip processing apparatus 1 according to the present invention is reduced to 29.16 meters.

In the above-noted FIG. 18, in the pre-dryer/thermosol setter 207, because the cloth strip 5 makes two passes at different times, it is desirable to provide at least two processing zones. It is possible to have the same temperature conditions in each of these processing zones, and in the case in which the purpose of each of the processing zones is different, it is possible to set mutually different processing conditions in each of the processing zones.

In the same manner, in the processing bath 214 which comprises an integrated scouring drying/water washing drying/heat setter in the above-noted FIG. 18, because the cloth strip 5 makes three passes at different times, it is desirable to provide at least three processing zones. It is possible to have the same temperature conditions in each of these processing zones, and in the case in which the purpose of each of the processing zones is different, it is possible to set mutually different processing conditions in each of the processing zones.

In the present invention, a tension-changing means T which changes the tension applied to the cloth strip is provided at the input section or output section of at least one of the processing zones, for example of 1-2, which is form in the processing section 1B as shown in FIG. 1, at least one part of the cloth strip 5 which travels through the inside of the processing section 1B being passed through the tension-changing means T, thereby enabling the cloth strip 5 to have different tensions applied to it as it passes through and is processed at the various zones within the processing section.

Referring to the example that is shown in FIG. 18, for example, the tension-applying apparatus T1 which comprises the metal pre-mangle 205, the metal post-mangle 203, and the dancer roller in the processing area 216 corresponds to the tension-changing means T of the present invention.

That is, the tension-applying apparatus T1 comprising the dancer roller is a tension-applying apparatus that was well known in the past, and which enables arbitrary setting of the load, the metal pre-mangle 205 and the metal post-mangle 203 being controlled by a control signal which is output from the tension-applying apparatus T1 that corresponds to the relative rotational speed of each of the rotating roller groups, thereby enabling the application of the prescribed tension to the cloth strip.

As described above, in another aspect of a continuous cloth strip processing apparatus 1 according to the present invention, at least one long belt-like cloth strip is processed by a plurality of processing zones as it moves continuously by the plurality of processing zones, the cloth strip passing first through at least a first processing section that forms one part of the plurality of processing sections so as to be processed thereby, after which it passes to at least a second processing section, at which it receives processing that differs from the processing of the first processing section, after which it once again is returned to the above-noted first processing section.

In implementing the above-noted aspect of the present invention, it is desirable that at least one of the above-noted processing sections be divided in the direction of travel of the cloth strip therewithin into a plurality of processing zones, and that at each of these processing zones a processing that either has the same purpose as or a different purpose from the processing at other zones is performed.

Figure 22A:
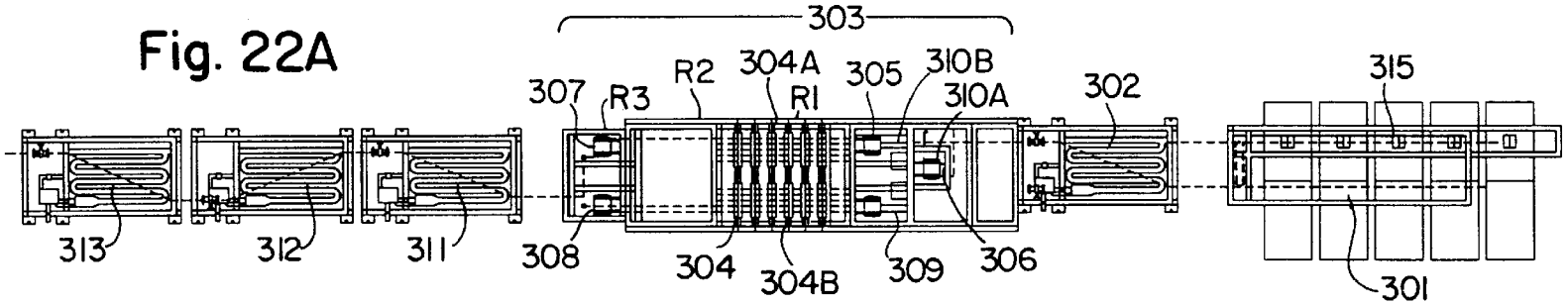
FIG. 22 is a drawing which shows another example of a continuous processing apparatus according to the present invention, FIG. 22(A) being a plan view, and FIG. 22(B) being a side view.
Figure 22B:
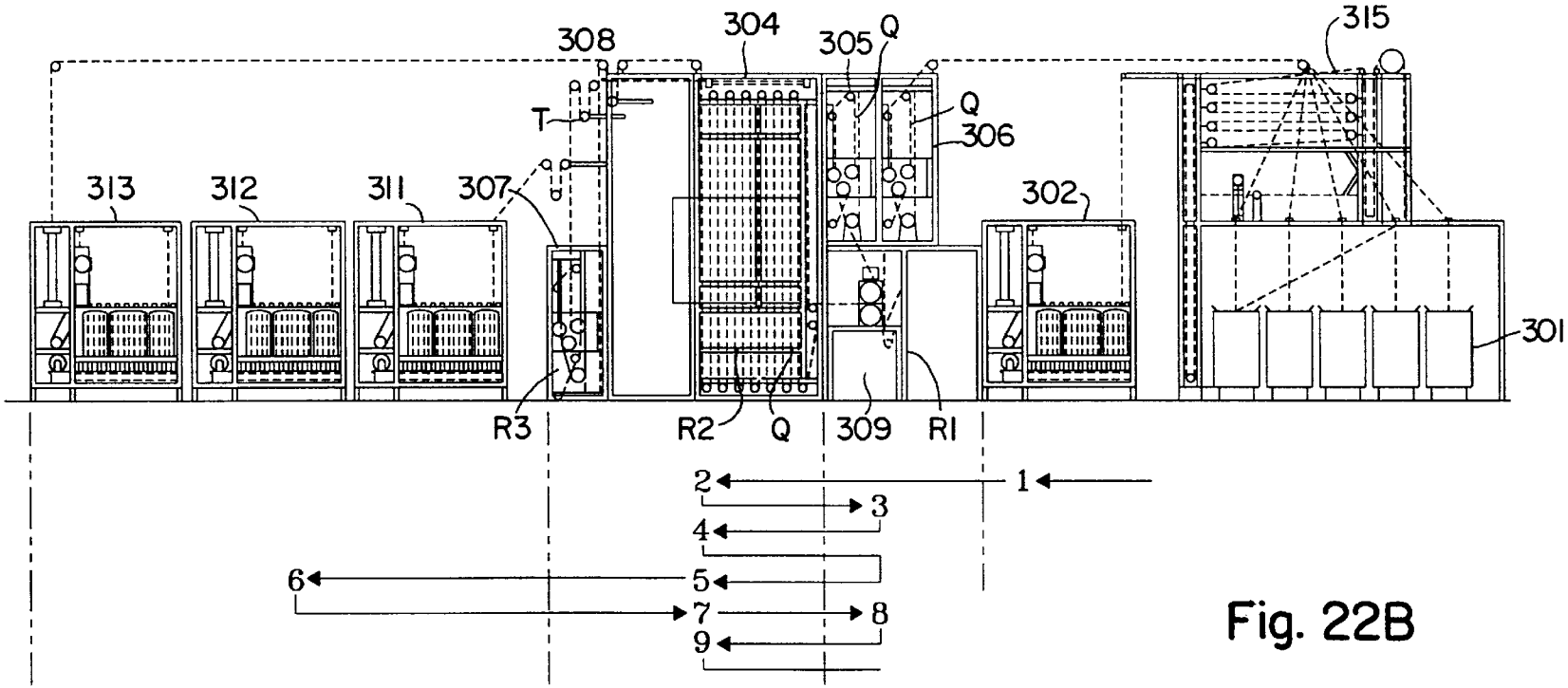

FIG. 22(A) and FIG. 22(B) are a plan view and a side elevation view of the above-noted example of the present invention, the direction of travel of the cloth strip 5 also being shown.

Specifically, in continuous cloth strip processing apparatus 1 shown in the example of FIG. 22, starting from the right side of the drawing, the apparatus comprises a cloth input apparatus 301, a cloth output apparatus 315, a scouring bath 302, metal pre-mangles 305 and 309, a metal post-mangle 306, dye/oil padder units 310(A) and 310(B) (these dye/oil padder units 310(A) and 310(B) comprising a dye bath or oil bath and a conventional squeezing roller), a combination scouring dryer/pre-dryer/thermosol setter/water washing dryer/heat setter 304 (divided into regions (A) and (B)), a cooling unit 307, a metal post-mangle 308 and three stages of water washing comprising the first, second, and third water washing baths 311, 312, and 313, respectively, the above-noted elements being disposed continuously in a straight line.

In this example, in performing the prescribed processing on a cloth strip 5 using the continuous processing apparatus 1, as indicated by the path of the cloth strip 5 at the bottom of FIG. 22(B), the cloth strip 5 to be processed is first supplied from the cloth input apparatus 301, and then it receives scouring and washing processing at the scouring bath 302 indicated as <1>, after which it is supplied to the low-temperature zone of the combination scouring dryer/pre-dryer/thermosol setter/water washing dryer/heat setter 304(A) indicated as <2>, the cloth strip passing through the scouring drying processing zone of the processing zone 304(A), after which it passes through the cooling unit 307 and travels in the reverse direction so as to enter the metal pre-mangle 309 and integrated dye padder unit 310(A) which form the dye application zone indicated as <3>, at which it has a prescribed dye applied thereto. Then the cloth strip 5 is returned again to the combination scouring dryer/pre-dryer/thermosol setter/water washing dryer/heat setter 304. The cloth passes through the pre-drying processing region of the high-temperature zone 304(B) of this processing bath 304, after which it passes through the metal pre-mangle 309 and, as shown at <5> is once again returned to the combination scouring dryer/pre-dryer/thermosol setter/water washing dryer/heat setter 304, at thermosol setting processing zone of the high-temperature zone 304(B) of which it is color developed, after which it further passes through the metal post-mangle 308, a prescribed tension being applied thereto between the metal pre-mangle 309 and the metal post-mangle 308.

After the cloth strip 5 passes through the color development processing of the processing zone, it passes through the three stages of water washing, these being the first, second, and third water washing baths 311, 312, and 313, respectively, which make up the water washing zone indicated as <6>. Thereafter, the cloth strip 5 is returned yet again to the combination scouring dryer/pre-dryer/thermosol setter/water washing dryer/heat setter 304, where it enters the water washing drying processing zone of the low-temperature region 304(A) of this processing bath 304.

Thereafter, the cloth strip 5 returns to the metal pre-mangle 305 and integrated dye padder unit 310(B) indicated at <8>, at which the prescribed oil is applied thereto, after which the cloth strip 5 passes through the metal pre-mangle 305 and, as shown at <9> returns again to the combination scouring dryer/pre-dryer/thermosol setter/water washing dryer/heat setter 304 and receives final heat setting processing at the final heat setting processing zone of the low-temperature region 304(A) of this processing bath 304, after which it passes through the metal post-mangle 306, a prescribed tension being applied thereto between the metal pre-mangle 305 and the metal post-mangle 306.

Next, the cloth strip 5 skips by the scouring bath 302 and is held as the final product in the cloth output apparatus 315 which is provided as one with the cloth input apparatus 301.

The processing mechanism 303, which forms the main part of the continuous processing apparatus 1 in the above-noted example, is internally divided into three blocks. The first block R1 comprises dye/oil padder units 310(A) and (B), and the integrated combination of a metal pre-mangle 309, a metal pre-mangle 305, and a metal post-mangle 306. The second block R2 comprises a processing bath 304 comprising the integrated scouring dryer/pre-dryer/thermosol setter/water washing dryer/heat setter combination, and a gas combustion apparatus for the purpose of heating the above-noted processing bath, the above-noted processing bath 304 further having a low-temperature region 304(A) and a high-temperature region 304(B).

The third block R3 comprises the integrated combination of a cooling unit 307, a metal post-mangle 308, and a tension-control mechanism.

The cloth strip 5 which starts at the cloth input apparatus 301 and passes through the scouring bath 302, skips the first block R1 of the above-noted processing mechanism 303, and passes through 304(A) of the second block R2 thereof, reaching the cooling unit 307 of the third block R3, after which the direction of travel of the cloth strip 5 is reversed, the cloth strip skips by the second block R2, returning to the dye padder unit 310(A) provided in the first block R1, it then being reversed in direction once again so as to feed to the original direction of travel, whereupon it passes through 304(B) of the second block R2, after which it once again reverses direction and reaches the metal pre-mangle 309 of the first block R1.

Then, the cloth strip 5 passes by 304(B) of the second block R2 in the original direction once again, passing through 308 of the third block R3 and, after passing through the first, second, and third water baths 311, 312, and 313, it reverses direction of travel once again to pass by 304(A) of the second block R2, thereby reaching the oil padder unit 310(B) of the first block R1.

The cloth strip 5 next travels to the metal pre-mangle 305 within the first block R1, after which it reverses its direction of travel and passes by the final heat setter zone 304(A) of the second block R2, after which its direction of travel is once again reversed, so that after it passes the metal post-mangle 306 of the first block R1, it travels to the cloth output apparatus 315, which is provided as one with the cloth input apparatus 301, in which it is held as final product.

In this example of the present invention, a cloth strip traveling direction changing apparatus 2 according to the present invention is located at the part indicated by the symbol Q in FIG. 22, so that the traveling direction of the cloth strip 5 is moved up and down, left and right, and also forward and backward (that is, including reverse feed) as the cloth strip 5 is processed.

According to the above-noted configuration, the overall length of the continuous cloth strip processing apparatus 1 according to the present invention is 21.65 meters, thereby providing a further decrease in the required surface area, in comparison with the first and second examples.

As is clear from the above-noted example, in the present invention it is possible to internally divide a processing section that-forms one processing zone into a plurality of processing zones, and further possible to have mutually different cloth strip processing conditions set into each of the plurality of processing zones.

Thus, in the present invention in the plurality of processing zones within a single processing section, it is possible to have the cloth strip fed into the processing apparatus and processed, after which one and the same cloth strip which has already been processed at a different processing section.

For example, it is desirable to have the combination scouring dryer/pre-dryer/thermosol setter/water washing dryer/heat setter 304 in FIG. 22 divided into at least two regions 304(A) and 304(B), and to separately perform the prescribed processing at each, these processings being mutually different.

As is clear from the above-noted example, in the present invention, it is also possible after processing the cloth strip which is fed into the processing apparatus at one selected processing zone of a plurality of processing zones in above-noted one processing section, to perform different processing of the cloth strip in a different processing section or in a different processing zone of the same processing section, after which the cloth strip is caused to return to the above-noted selected processing zone, at which it receives the same processing once again.

In the present invention, as is clear from the above-noted example, it is possible to have the arrangement direction of a part of the processing sections of the plurality of processing zone in FIG. 1, for example 1C and 1D, be different from the straight line arrangement of the other processing zones 1A and 1B, so that this direction is at certain angle with respect to the straight line arrangement direction of the processing sections 1A and 1B.

That is, in the present invention, it is possible in the present invention when causing the cloth strip to travel from at least one processing section selected from the group of processing sections to at least another selected processing section, to be able to set a direction of travel of the cloth strip that is arbitrarily different from the direction of travel of the cloth strip from the other processing section to yet another processing section.

In addition, in the present invention, it is possible to use a configuration in which the direction of travel of the cloth strip from at least a first processing section to at least a second selected processing section is in reverse from the direction of travel of the cloth strip when traveling from the second processing section to at least yet a third processing section.

An example of the continuous cloth strip processing apparatus according to the present invention is described below.

Figure 23:
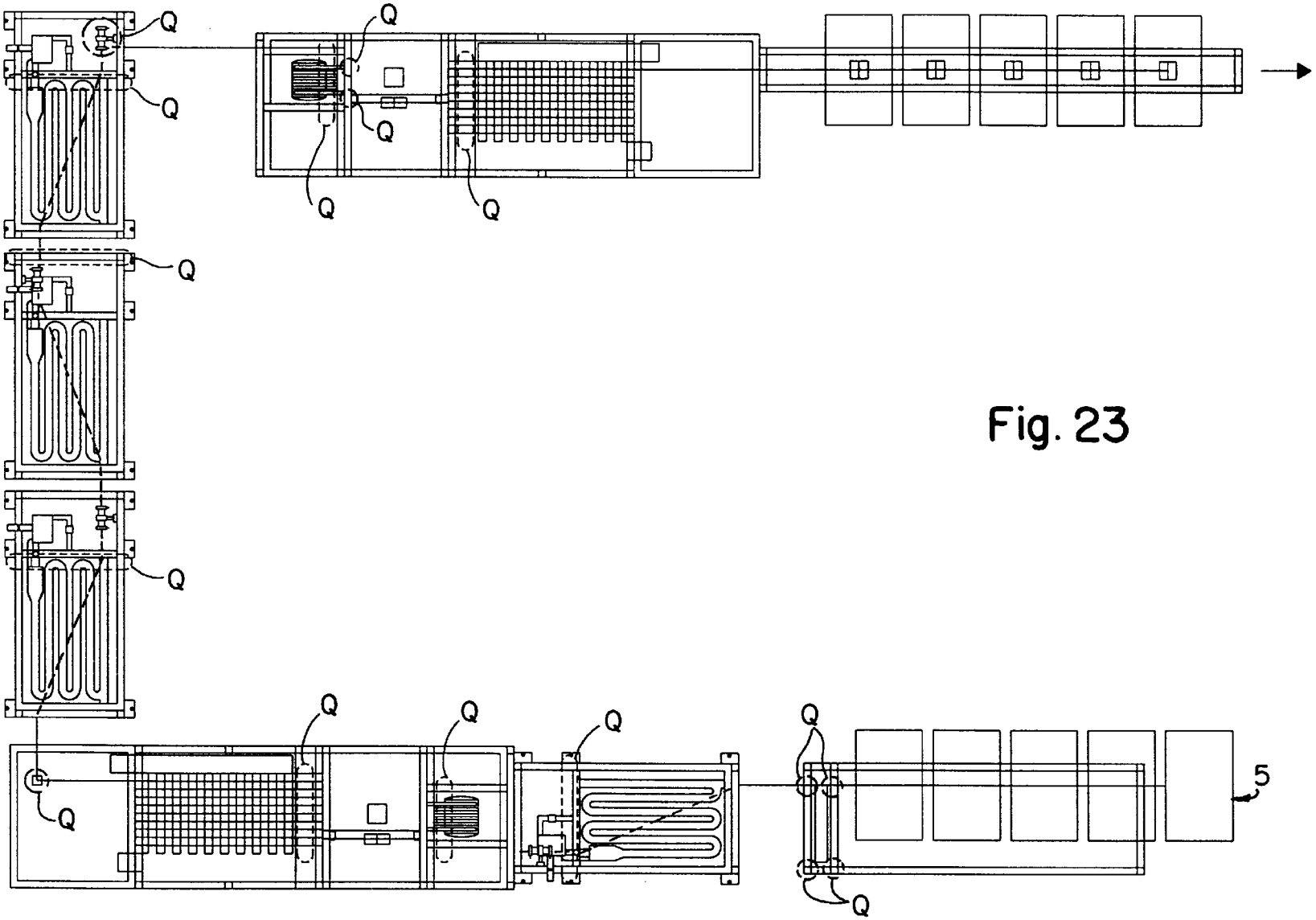
FIGS. 23 through 27 are plan views and side views which show examples of arrangements of a plurality of processing zones in a continuous processing apparatus according to the present invention.
Figure 24:
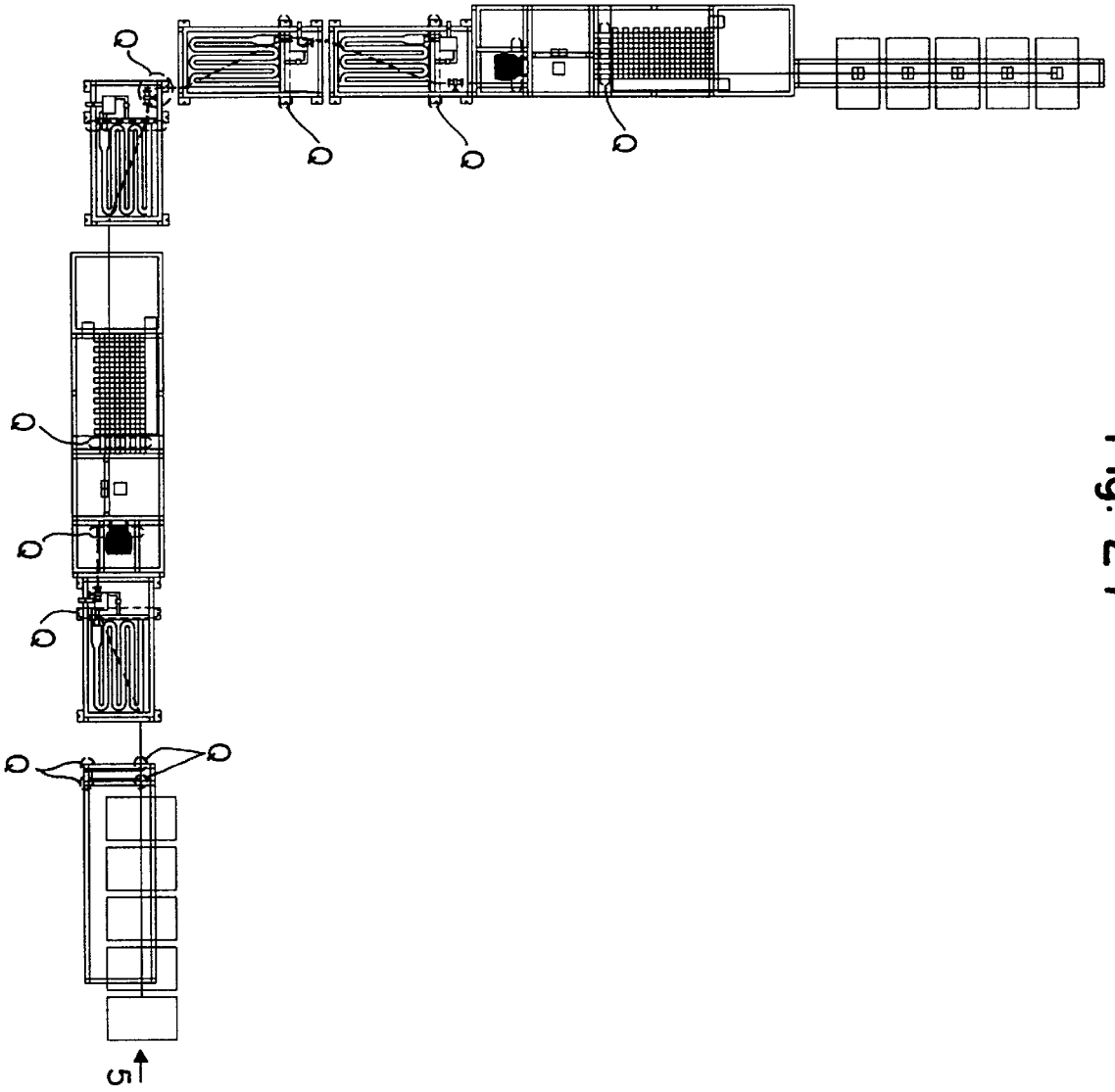

FIG. 23 shows a continuous cloth strip processing apparatus 1, in which some of or all of the processing zones <1> through <9> which are shown in FIG. 15 are suitably disposed in a U-shaped arrangement as shown in the drawing, wherein the traveling direction of the cloth strip is suitably adjusted by means of a cloth strip traveling direction changing apparatus 2 according to the present invention, so that the cloth strip traveling direction is changed to suit the arrangement of the processing zones. FIG. 24 shows an L-shaped arrangement of a continuous cloth strip processing apparatus according to the present invention, in which some or all of the processing zones <1> through <9> which are shown in FIG. 15 are suitably disposed in a L-shaped arrangement.

Figure 25:
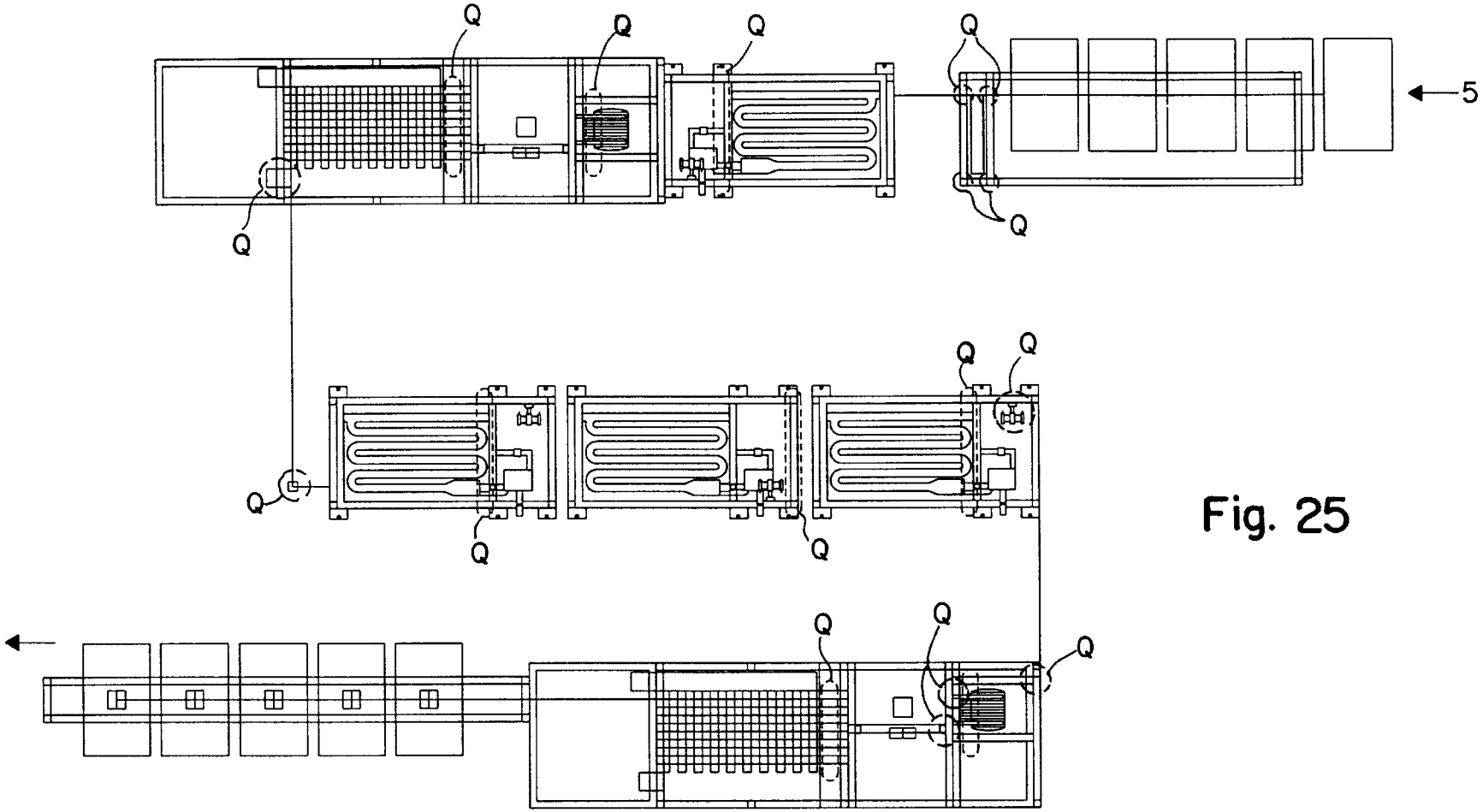

FIG. 25 shows a continuous cloth strip processing apparatus according to the present invention, in which some or all of the processing zones <1> through <9> which are shown in FIG. 15 are suitably disposed in an S-shaped arrangement as shown in the drawing.

Figure 26:
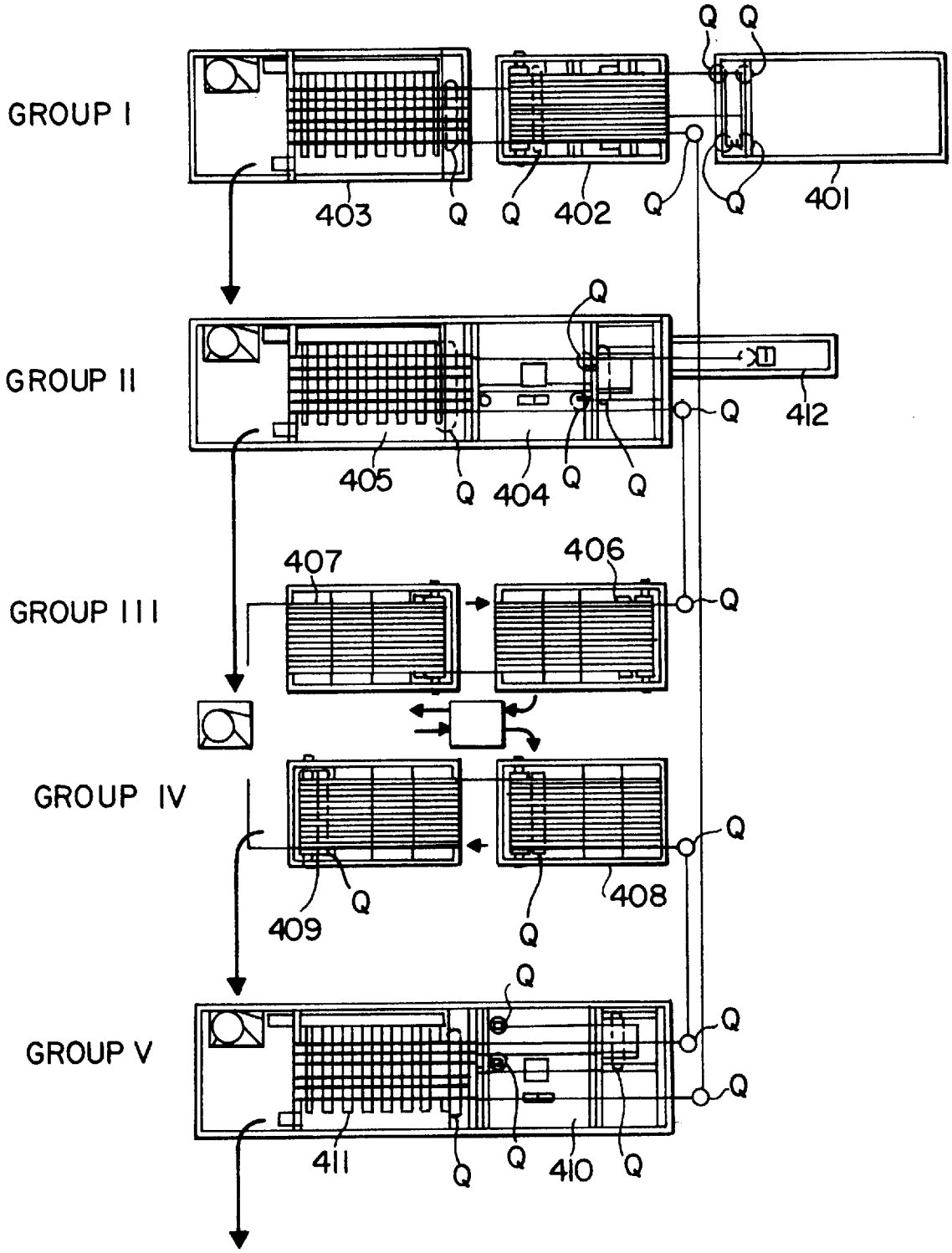

FIG. 26 shows a continuous cloth strip processing apparatus according to the present invention, in which the processing zones are arranged in lateral parallel fashion so that the cloth strip is caused to move in snake-like fashion therethrough, the configuration being such that some or all of the processing zones <1> through <9> are arranged in series to form a plurality of processing zone groups which are then arranged in parallel.

Specifically, a cloth input apparatus 401, a scouring processing section 402 which is integrated to include a cooling unit and a scouring bath, and a scouring dryer 403 form group I; a cloth output apparatus 412, an oil padder unit 404 which includes a tension control unit that has the same type of configuration and function as the above-noted metal pre-mangle 211 or metal post-mangle 212, and a processing bath 405 that includes an integrated water washing dryer and heat setter for group II; the two-stage series connected water baths 406 and 407 form group III; the two-stage series connected water baths 408 and 409 form group IV; and a dye padder unit 410 which includes a tension control unit that has the same type of configuration and function as the above-noted metal pre-mangle 205 or metal post-mangle 203, and a processing bath 411 which is an integrated pre-dryer and thermosol setter form group V. Each of the groups is arranged so as to be lined up in a mutually parallel arrangement, as shown in FIG. 26.

After the cloth strip 5 which receives the prescribed processing travels from the cloth input apparatus 401 to the scouring bath of the scouring processing section 402, it enters the scouring dryer 403, after which it reverses direction and travels to the cooling unit of the scouring processing section 402, after which it is supplied to the dye padder unit 410 of group V. This cloth strip 5 then travels to the pre-dryer processing zone of the processing bath 411, which is formed by a pre-dryer and a thermosol setter, after which it travels to the thermosol setter processing zone of the processing bath 411.

When this is done, the cloth strip 5 has a prescribed tension applied to it between the thermosol setter processing zone and the tension control unit which is included in the dye padder unit 410.

The cloth strip 5 which exits this tension control unit sequentially and continuously passes the water baths 408 and 409 which form group IV, after which it sequentially and continuously passes the water baths 407 and 406 which form group III, whereupon it enters the oil padder unit 404 that forms the group II.

Thereafter, the cloth strip 5 enters the water washing drying processing zone of the processing bath 405 which is formed by an integrated water washing dryer and heat setter, after which it travels to the heat setter processing zone.

When this is done, a prescribed tension is applied to the cloth strip 5 between the above-noted heat setter processing zone and the tension control unit which is included in the oil padder unit 404, after which the cloth strip 5 is finally taken up as a final product at the cloth output apparatus 412.

Figure 27:
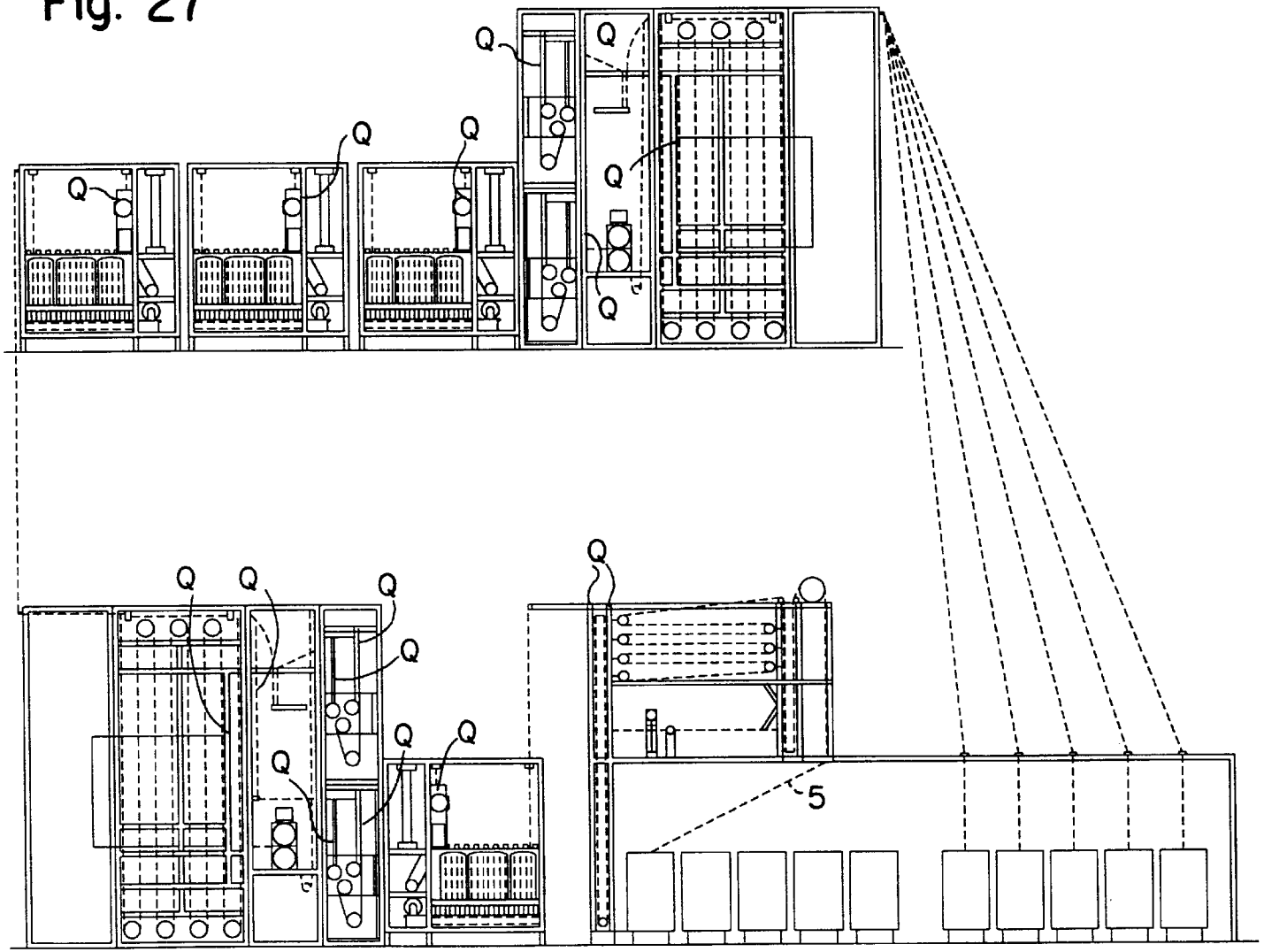

FIG. 27 shows an example of the continuous cloth strip processing apparatus 1 shown in FIG. 18 with a two-story vertical arrangement of the elements thereof.

That is, in the example shown in FIG. 27, in addition to arranging the processing zones which include the water washing baths 208 through 210 of FIG. 18 on the second story part, the cloth output apparatus 215 which is the final processing zone is disposed next to the cloth input apparatus 201, thereby enabling the effective use of the land area and an improvement in the working efficiency.

Effect of the Invention

In the present invention, in causing a cloth strip to pass a plurality of types of processes so as to perform the prescribed processing, by applying twisting to the cloth strip as it travels within a prescribed processing zone or between processing zones, the direction of travel is arbitrarily changeable, enabling an improvement in the degree of freedom of placement of the processing sections of the plurality of types of processing zones.

In the present invention, therefore, it is possible not only to use an arbitrary placement configuration of the plurality of types of processing zones, including a straight-line configuration, but also to freely change the direction of travel of the cloth strip 5 to an arbitrary configuration, including but not limited to a straight line.

As a result, in the present invention, in the case in which a cloth strip is processed by a plurality of types of processes, in addition to being able to efficiently design the placement of the processing sections that make up each of the processing zones, because it is possible to re-use a processing section which is part of a prescribed processing zone, it is also possible to improve the overall production efficiency, including the control of conditions for each of the processes, and to improve the working efficiency, thereby enabling a great reduction in the overall production cost.

Additionally, in the present invention, not only it is possible to reduce the size of the space occupied within a factory by the continuous cloth strip processing apparatus, it is also possible to design a continuous cloth strip processing apparatus that is suited for use in the open area of an existing plant, thereby providing a great improvement in the degree of freedom in designing the continuous cloth strip processing apparatus.

Moreover, there is no limitation in the present invention to the use of ail only a straight-line traveling direction for the cloth strip. It is possible to have the cloth strip travel in an arbitrary direction, including along a curve and travel in the reverse direction, thereby enabling a cloth strip which has traveled through a given processing zone to be reversed in direction so that it returns to the same processing zone, and enabling part of a processing zone or an entire processing zone to be eliminated. This not only saves in space, but also creates an overall reduction in the amount of energy consumed in processing the cloth strip.

TABLE 1

| Y Distance | Z Distance |
|---|---|
| 0.125 X | 5.7446 Y |
| 0.250 X | 3.0000 Y |
| 0.375 X | 2.1344 Y |
| 0.500 X | 1.7321 Y |
| 0.625 X | 1.5100 Y |
| 0.750 X | 1.3744 Y |
| 0.875 X | 1.2857 Y |
| 1.000 X | 1.2247 Y |
| 1.125 X | 1.1811 Y |
| 1.250 X | 1.1489 Y |
| 1.375 X | 1.1245 Y |
| 1.500 X | 1.1055 Y |
| 1.625 X | 1.0906 Y |
| 1.750 X | 1.0785 Y |
| 1.875 X | 1.0687 Y |
| 2.000 X | 1.0607 Y |
| 2.125 X | 1.0539 Y |
| 2.250 X | 1.0482 Y |
| 2.375 X | 1.0434 Y |
| 2.500 X | 1.0392 Y |
| 2.625 X | 1.0356 Y |
| 2.750 X | 1.0325 Y |
| 2.875 X | 1.0298 Y |
| 3.000 X | 1.0274 Y |
| 3.125 X | 1.0253 Y |
| 3.250 X | 1.0234 Y |
| 3.375 X | 1.0217 Y |
| 3.500 X | 1.0202 Y |
| 3.625 X | 1.0188 Y |
| 3.750 X | 1.0176 Y |
| 3.875 X | 1.0165 Y |
| 4.000 X | 1.0155 Y |
| 4.125 X | 1.0146 Y |
| 4.250 X | 1.0537 Y |
| 4.375 X | 1.0130 Y |
| 4.500 X | 1.0123 Y |
| 4.625 X | 1.0116 Y |
| 4.750 X | 1.0110 Y |
| 4.875 X | 1.0105 Y |
| 5.000 X | 1.0100 Y |

We claim:

1. A continuous cloth strip processing apparatus comprising:

a plurality of processing sections, each said processing section having an entrance part, an exit part, an internal part and at least one processing zone; and at least one long belt-like cloth strip moving continuously through a plurality of processing zones while receiving prescribed processing at each processing zone, wherein at least one of the processing sections includes at one location among said entrance part, said exit part or said internal part, at least one cloth strip direction changing apparatus having an introduction guide roller which has a rotational axis that is perpendicular with respect to the center line of said cloth strip that runs into said introduction guide roller, and a withdrawal guide roller which has a rotational axis that is perpendicular with respect to the centerline of said cloth strip that is withdrawn therefrom, wherein said rotational axes of said introduction guide roller and said withdrawal guide roller define a relative angle between said rotational axes, said relative angle being adjustable so that it can be changed to accommodate different arrangements of said cloth strip processing apparatus.

2. A continuous cloth strip processing apparatus according to claim 1, wherein changing the relative angle between said rotational axes changes the direction of travel of said cloth strip within said processing section.

3. A continuous cloth strip processing apparatus according to claim 1, wherein at least one said cloth strip direction changing apparatus is provided at said entrance part or said exit part of a selected processing section of said plurality of processing sections, and wherein changing the relative angle between the rotational axes changes the direction of travel of said cloth strip between said selected processing section and another selected processing section.

4. A continuous cloth strip processing apparatus according to any of one of claims 1 through 3, wherein an introduction surface of said cloth strip which enters said introduction guide roller and a withdrawal surface of said cloth strip which exits from said withdrawal guide roller are positioned at different planes, and further wherein a changing-angle surface, formed by said cloth strip between said introduction guide roller and said withdrawal guide roller, is set so as to connect said introduction surface and said withdrawal surface of said cloth strip while twisting through an arbitrary angle from said introduction guide roller to said withdrawal guide roller.

5. A continuous cloth strip processing apparatus according to claim 4, wherein said changing angle surface further defines a prescribed twist to said cloth strip between said two rollers so that the distance between a first contact point on said introduction guide roller and a second contact point on said withdrawal guide roller is at least three times the width of the cloth strip.

6. A continuous cloth strip processing apparatus according to claim 1, 2 or 3, wherein a first cloth strip direction changing apparatus is provided at a first direction changing point whereby at least one said cloth strip enters said first direction changing point along one travel path within said processing section, and a separate second cloth strip direction changing apparatus is provided at a second direction changing point which receives said cloth strip after said cloth strip exits said first cloth strip direction changing apparatus, thereby causing said cloth strip to travel along an adjacent travel path to said one travel path forming mutually parallel adjacent traveling paths.

7. A continuous cloth strip processing apparatus according to claim 6, wherein said mutually parallel adjacent traveling paths are within one and the same processing section.

8. A continuous cloth strip processing apparatus according to claim 7, further comprising at least a second separate cloth strip forming said mutually parallel adjacent traveling paths formed within said one and the same processing section.

9. A continuous cloth strip processing apparatus according to claim 1, 2 or 3, wherein the physical arrangement of said plurality of processing sections defines a first sequence of said processing sections, said first sequence of processing sections having a different order than the order in a second sequence of processing sections defined by said processing sections in order of the route that said cloth strip travels through each processing section.

10. A continuous cloth strip processing apparatus according to claim 1, 2 or 3, wherein at least one part of the plurality of processing sections is disposed so that it is not along the same straight line as other processing sections.

11. A continuous cloth strip processing apparatus according to claim 1, 2 or 3, wherein at least one said processing section further includes a tension-changing means for changing tension applied to said cloth strip, said tension-changing means being provided at either said entrance part or said exit part of at least one said processing section wherein prescribed processing is performed on said cloth strip at mutually different tension conditions as said cloth strip travels through said processing section.

12. A continuous cloth strip processing apparatus according to claim 1, 2 or 3, wherein said cloth strip first passes through and is processed at a first processing section of said plurality of processing sections before traveling to at least a second processing section, whereby said cloth strip receives processing which is different from the processing at said first processing section, and after said cloth strip exits said second processing section, said cloth returns to said first processing section.

13. A continuous cloth strip processing apparatus according to claim 1, 2 or 3, wherein said at least one processing section is further internally divided into a plurality of processing zones, the purpose of the processing performed on said cloth strip at each said processing zones being either the same as or different from the purpose of the processing performed at the other processing zones within said one processing section.

14. A continuous cloth strip processing apparatus according to claim 13, wherein each of said plurality of processing zones provided in said one processing section has conditions for processing of said cloth strip which are mutually different from processing in any other said processing zone within said one processing section.

15. A continuous cloth strip processing apparatus according to claim 13, wherein said cloth strip first is processed at a first processing zone of said plurality of processing zones in said one processing section, then said cloth strip is processed in another processing section, whereby said processing in said another processing section is different from said processing in said first processing zone, after which, said cloth strip is returned to said first processing section for processing in a separate second processing zone within said one processing section.

16. A continuous cloth strip processing apparatus according to claim 13, wherein said cloth strip is processed at one processing zone selected from said plurality of processing zones in one said processing section, and then processed in a separate processing zone in a different processing section or the same processing section, after which said cloth strip is returned to said one selected processing zone.

17. A continuous cloth strip processing apparatus according to claim 1, 2 or 3, wherein at least one of said guide rollers is rotatable mounted on said cloth strip direction changing apparatus, whereby a guide roller angle can be set arbitrarily, said guide roller angle defined between a line forming a direction of said cloth strip moving from said introduction roller to said withdrawal roller and a line defined by said rotational axis of said rotatably mounted guide roller.

18. A continuous cloth strip processing apparatus according to claim 1, 2 or 3, wherein at least one said introduction guide roller and one withdrawal guide roller are configured as one unit.

19. A continuous cloth strip processing apparatus according to claim 18, wherein at least one said unit is provided in at least one of said entrance part, said exit part and said internal part of at least one of the plurality of processing sections.

20. A continuous cloth strip processing apparatus according to claim 19, wherein two said units are used as one group.

21. A continuous cloth strip processing apparatus according to claim 3, wherein when causing said cloth strip to travel from at least a first processing section selected from said plurality of processing sections to at least a second selected processing section, a direction of travel of said cloth strip from said first processing section to said second processing section is different from the direction of travel of said cloth strip from said second processing section to yet a third processing section.

22. A cloth strip processing method according to claim 3, wherein a first direction of travel of said cloth strip moving from at least a first processing section selected from said plurality of processing sections to at least a second selected processing section is an opposite direction from a second direction of travel of said cloth strip moving from at least a third selected processing section to a fourth selected processing section.

* * * * *

UNITED STATES PATENT AND TRADEMARK OFFICE

CERTIFICATE OF CORRECTION

PATENT NO. : 5,881,939
DATED : March 16, 1999
INVENTOR(S) : Kikuchi et al.

It is certified that error appears in the above-identified patent and that said Letters Patent is hereby corrected as shown below:

Column 1, line 67, delete "the," and insert

--the-- therefor

Column 2, line 57, delete "ship" and insert

--strip-- therefor

Column 2, line 57, delete "tat" an insert

--that-- therefor

UNITED STATES PATENT AND TRADEMARK OFFICE

CERTIFICATE OF CORRECTION

PATENT NO. : 5,881,939
DATED : March 16, 1999
INVENTOR(S) : Kikuchi et al.

It is certified that error appears in the above-identified patent and that said Letters Patent is hereby corrected as shown below:

Column 4, line 38, before "within" insert

--can be--

Column 4, line 45, delete "S-2" and insert

--5-2-- therefor

Column 6, line 2, after "configuration 9"

insert --,--

Column 8, line 36, after "as a side" insert

--,--

Column 8, line 38, delete "one side," and insert --one side-- therefor

UNITED STATES PATENT AND TRADEMARK OFFICE

CERTIFICATE OF CORRECTION

PATENT NO. : 5,881,939
DATED : March 16, 1999
INVENTOR(S) : Kikuchi et al.

It is certified that error appears in the above-identified patent and that said Letters Patent is hereby corrected as shown below:

Column 8, line 47, after "edge" insert

--part--

Column 12, line 38, delete "which"

Column 12, line 50, delete "meters" and insert --meters.-- therefor

Column 13, line 51, after "single processing"

insert --zone,--

Column 16, line 35, after "above-noted"

insert --example of--

UNITED STATES PATENT AND TRADEMARK OFFICE

CERTIFICATE OF CORRECTION

PATENT NO. : 5,881,939
DATED : March 16, 1999
INVENTOR(S) : Kikuchi et al.

It is certified that error appears in the above-identified patent and that said Letters Patent is hereby corrected as shown below:

Column 16, line 45, after "above-noted"

insert --example of--

Column 16, line 56, delete "form" and insert

--formed-- therefor

Column 17, line 59, delete "304(A), after"

and insert --304(A). After-- therefor

Column 21, line 62, delete "ail"

UNITED STATES PATENT AND TRADEMARK OFFICE

CERTIFICATE OF CORRECTION

PATENT NO. : 5,881,939
DATED : March 16, 1999
INVENTOR(S) : Kikuchi et al.

It is certified that error appears in the above-identified patent and that said Letters Patent is hereby corrected as shown below:

Column 22, line 2, delete "saves in" and insert --saves-- therefor

Column 24, line 2, after "processing section"

insert --,--

Signed and Sealed this

Fourth Day of April, 2000

*Attest:*

*Attesting Officer*

Q. TODD DICKINSON

*Director of Patents and Trademarks*